US012071738B2

(12) United States Patent
Farmer

(10) Patent No.: US 12,071,738 B2
(45) Date of Patent: Aug. 27, 2024

(54) AIR-OPERATED HAMMER

(71) Applicant: Equipment Corporation of America, Coraopolis, PA (US)

(72) Inventor: Richard R Farmer, St Augustine, FL (US)

(73) Assignee: Equipment Corporation of America, Coraopolis, PA (US)

( * ) Notice: Subject to any disclaimer, the term of this patent is extended or adjusted under 35 U.S.C. 154(b) by 159 days.

(21) Appl. No.: 17/549,500

(22) Filed: Dec. 13, 2021

(65) Prior Publication Data

US 2022/0186455 A1 Jun. 16, 2022

Related U.S. Application Data

(60) Provisional application No. 63/124,530, filed on Dec. 11, 2020.

(51) Int. Cl.

| | |
|---|---|
| ***E02D 7/10*** | (2006.01) |
| ***B21J 7/24*** | (2006.01) |
| ***E02D 7/12*** | (2006.01) |
| *E02D 7/02* | (2006.01) |

(52) U.S. Cl.

CPC ..... *E02D 7/10* (2013.01); *B21J 7/24* (2013.01); *E02D 7/125* (2013.01); *E02D 7/02* (2013.01)

(58) Field of Classification Search

CPC ..... E02D 7/10; E02D 7/125; E02D 7/263; E02D 27/48; E02D 35/00; E02D 7/02; B21J 7/24

USPC ..... 173/4, 13, 19, 115, 136, 206, 207, 90, 173/133; 405/230

See application file for complete search history.

(56) References Cited

U.S. PATENT DOCUMENTS

| | | | | | |
|---|---|---|---|---|---|
| 2,613,923 | A * | 10/1952 | Cornett | E01C 23/124 | 173/127 |
| 2,982,103 | A * | 5/1961 | Revesz | E04G 23/04 | 405/230 |
| 3,838,741 | A * | 10/1974 | Pepe | E02D 7/10 | 173/136 |
| 3,902,326 | A * | 9/1975 | Langenbach, Jr. | E02D 35/00 | 405/230 |
| 4,106,569 | A * | 8/1978 | Edgworth | E02D 7/10 | 173/1 |
| 4,523,647 | A * | 6/1985 | Last | E02D 7/125 | 173/133 |
| 6,619,407 | B1 * | 9/2003 | Hawkins | E02D 7/10 | 173/127 |

(Continued)

*Primary Examiner* — Scott A Smith

(74) *Attorney, Agent, or Firm* — Paul D. Bangor, Jr.; Clark Hill PLC

(57) ABSTRACT

An air-operated hammer, comprising a hollow ram; a frame; an air cylinder and piston assembly disposed within the ram, wherein a top of the cylinder and piston assembly is attached to a top of the frame and wherein a piston rod of the cylinder and piston assembly is attached to a bottom of the ram; an air flow control valve mounted on and in fluid communication with a manifold disposed on a top of the frame; a first pressurized air reservoir comprising a first flexible hose of a first size attached to an outside surface of the frame, wherein lifting of the ram is caused by pressurized air from the pressurized air reservoir being supplied to and entering a bottom of the cylinder, wherein pressurized air entering a bottom portion of the cylinder causes the piston to raise the ram.

6 Claims, 24 Drawing Sheets

(56) References Cited

U.S. PATENT DOCUMENTS

| | | | | |
|---|---|---|---|---|
| 7,926,690 | B1 * | 4/2011 | Tippmann, Sr. ..... | F01B 11/04<br>173/208 |
| 9,803,388 | B2 * | 10/2017 | Cunningham ..... | E04H 17/263 |
| 2011/0155403 | A1 * | 6/2011 | Rohrer ..... | E02D 7/10<br>173/128 |

* cited by examiner

AIR-OPERATED HAMMER

RELATED APPLICATION

This application claims priority benefit under 35 U.S.C. § 119(e) of U.S. Provisional Application No. 63/124,530 filed Dec. 11, 2020 the contents of which are herein incorporated by reference.

FIELD OF THE DISCLOSURE

Technical field

The present disclosure generally relates to the field of air-operated hammers.

BACKGROUND OF THE DISCLOSURE

The present disclosure relates to an improved air-operated hammer. The uses for which the subject air-operated hammer find application include, but are not limited to, pile hammers, concrete breakers, forging hammers, and compacting hammers.

Current air-operated hammers, such as those disclosed in U.S. Pat. No. 6,619,407 issued Sep. 16, 2003 (the "'407 Patent), typically have an external compressed-air source which supplies pressurized air to the hammer, for example via an air hose. This pressurized air is used to lift the hammer's head such that gravity, and/or additional mechanisms, can drive the hammer head down, for example to drive a piling into the ground. Once the hammer head drops and reaches the object it is intended to contact, the hammer can again begin to accept pressurized air in such a fashion as to lift the hammer head back up.

Accordingly, the expansion of the received pressurized air supplies the work needed to raise the hammer head during the operation of the hammer. The rate at which the hammer head is raised is therefore dependent on the pressure and the rate of flow of the pressurized air into the hammer. In order to raise the hammer faster, an air source with a larger flow rate and/or higher pressure is needed.

Once the hammer head is raised, for example to a predetermined position, the flow of pressurized air into the hammer is typically shutoff by some sort of valve on the hammer in order to allow the hammer head to drop during the down stroke. Accordingly, during the period of time that the hammer head is falling the compressed-air supply is typically not supplying air to the hammer.

Referring to FIGS. 1A and 1B, a front view of a specific embodiment of an air-operated hammer of the '407 Patent is shown in the hammer head up position and hammer head down position, respectively. FIGS. 2A and 2B show cross-sectional views of the hammer through section A-A. In this embodiment, pressurized-air reservoir 2 can also function as a frame for the subject air-operated hammer. The use of tubing for the reservoir, which also functions as the frame, can produce a hammer which is strong, light weight, and durable. Furthermore, by having the reservoir serve as a frame, the hammer can be smaller and, therefore, more maneuverable and versatile. In addition, the frame of the subject hammer, when designed to be an air reservoir, can also function as a water separator, for example a cyclone separator to separate water from the incoming air. For example, the reservoir can be designed such that the incoming air enters on a tangent allowing the air to swirl around the reservoir such that water in the air separates from the air and drops into a section of the reservoir for collection and convenient removal.

In the '407 Patent, it was preferred to have the pressurized air reservoir as close to cylinder 7 as possible. Cylinder 7 can be a chamber wherein piston 5 resides, and is preferably cylindrical in shape. Cylinder 7 can accept pressurized air which raises piston 5 and, therefore, hammer head 12 which is connected to piston 5 via rod 9. In an optimal design the reservoir can accept incoming air continuously and discharge air intermittently, for example during, the up stroke of the hammerhead. The proximity of the air reservoir to the cylinder reduces friction loss and pressure drop due to the travel of the air. In contrast, current air-operated hammers are typically supplied with compressed air via a 50 to 100 foot air hose, resulting in friction losses and a lower air pressure at the output of the hose than at the input.

In a specific embodiment of the '407 Patent, referring to FIG. 1A, connected to frame 2 is cross-member 4*a* which can act to tie the vertical frame together. In addition, cross-member 4*b* can act as a mounting bracket for cylinder head 10, cylinder 7, and valve assembly 8. Cross-member 4*a* can act to tie the top of frame 2 together and can also act to locate the top of cylinder 7. A vertical stiffener plate, not shown in the Figures, can act to tie cross-members 4*a* and 4*b* together and can also act to tie the right and left sides of frame 2 together. In a specific embodiment of the '407 Patent, the volume between cross members 4*a* and 4*b* can be enclosed by wall 37 creating a cavity which can be used as a pressurized air reservoir or to augment pressurized air reservoir 2. This cavity can encapsulate cylinder 7. The portion of the tubed framing 2 within this cavity can have apertures which allow air to pass freely between the cavity and the frame tubing thereby forming one large air reservoir including the frame tubing and the cavity.

Cylinder head valve 8 can be designed into cylinder head 10 and ported directly to reservoir 2, reducing friction loss from reservoir 2 through cylinder head 10. Cylinder head 10 can house a double action three port air-actuated valve. A variety of valving designs were able to be implemented with such prior air-operated hammer. A specific embodiment of a double action three port air-actuated valve 8 is shown in FIGS. 5A and 5B for the inlet air open position and the inlet air closed position, respectively. Preferably, the body of valve 8 can be formed as an integral part of cylinder head 10. In a specific embodiment of the '407 Patent, the body of valve 8 can house three ports. First, an inlet port can allow pressurized air, for example from an external pressurized air source, to enter and pass through the valve body and enter cylinder 7 when valve 8 is in the inlet air open position. Second, an outlet port can allow air to exit cylinder 7, through valve 8, via the outlet port into the environment when valve 8 is in the inlet air closed position. Finally, a cylinder port 20 which allows pressurized air, for example from control valving, to enter valve 8 in order to push the valve stem over to the inlet air open position.

The valve can be designed with a single stem 21 and two seats 18 and 19 such that when the inlet seat is open, the outlet, or exhaust, seat is closed. Conversely, when the inlet seat is closed, the outlet, or exhaust, seat is open. The valve stem can be air actuated such that pressurized air can enter the cylinder port and push the valve stem over to open the inlet seat and close the outlet seat. When the pressurized air supply is shut off at the cylinder port, spring 17 can push the valve stem back over to close the inlet seat and open the outlet seat.

In a design where the cylinder head acts as the valve body, cylinder head 10 can also attach cylinder 7 to frame 2. Accordingly, cylinder head 10 can perform at least three functions. Preferably, cylinder head 10 connects directly to reservoir 2, allowing large volume of high pressure air to pass directly from reservoir 2, through valve 8, to cylinder 7 with a minimum of pressure loss, and rapid exhaust of cylinder air from cylinder 7, through valve 8, out outlet port to the outside environment, with a minimum of restriction. Valve 8 can also have porting to allow the various pressures to be monitored throughout the hammer cycle. For example, valve 8 can be ported such that the pressure at the bottom of cylinder 7 can be read through an outlet port on valve 8. As discussed above, valve 8 can also be ported, for example port 20, to, operate the low-pressure cycle valve 8.

Hammer head 12 can be designed with a large solid metal, for example steel, contact head. The upper part of the hammer head 12 can be filled, for example with lead, to give a maximum dead blow effect. Each side of hammer head 12 can have insert bushings that assure alignment with the frame throughout the cycle. Advantageously, the entire hammer assembly can be disassembled and reassembled within one hour including hammer head 12, anvil. 16*a,* anvil skirt 16*b,* hammer rod 9, cylinder head 10, and cylinder 7.

In operation, anvil 16*a* can sit over the top of an object, for example a piling, to be struck, where anvil skirt 16*b* guides the piling up under anvil 16*a* and holds the piling in place. In a specific embodiment, anvil 16*a* can move between top and bottom stops 14*a* and 14*b,* respectively. Anvil 16*a* can float up and down on bushings for example providing approximately 3 ½" of travel. Preferably, the entire hammer can be placed over the top of an object to be contacted, for example a piling, with anvil 16*a* on top of the piling such that stop 14*a* top rests on anvil 16*a*. Hammer head 12 is then driven upward by pressurized air entering cylinder 7 and then free-falls to strike anvil 16*a,* driving the piling down. An embodiment which allows anvil 16*a* to float between stops 14*a* and 14*b* can reduce stresses on the frame and various components of the hammer and allow a larger portion of the momentum of the hammer head to be transferred to the object being contacted, rather than to the body of the hammer itself. Accordingly, this reduces wear and tear on the hammer and increases the efficacy of the hammer.

Hammer head 12 can have bushings on either side to guide it as it is pushed up and as it free-falls down, along frame 2. The bottom end of rod 9 can be attached to hammer head 12 by pin 13. The top end of rod 9 can pass through cylinder head 10 and attach to piston 5 located within cylinder 7. When valve 8 opens the air inlet port to let air in from high-pressure reservoir 2 to pass through valve 8 to cylinder 7, the pressurized air drives piston S upward pulling the hammer head 12 toward the top of its cycle. After cycling of valve 8, air from within cylinder 7 can pass through valve 8 and out exhaust port 11, allowing hammer head 12 to free-fall back down to anvil 16*a,* driving the piling. The cycle can then begin again.

The following is how a specific embodiment of an automatic control valve system of the '407 Patent can affect the cycling of the hammer through the up and down strokes. With reference to FIG. 6A, valve 18 is closed and valve 19 is open. Whereas in FIG. 6B, valve 18 is open and valve 19 is closed. Preferably, the control valves are operated by high-pressure air. A high-pressure air supply feeds in, as shown in FIG. 6B, and is constantly supplied at port 1 of 4-way valve 23, port 1 of low pressure valve 24, and port 1 of limit valve 26. Starting the description of the control valve system when the hammer is at the bottom of the down stroke, see FIG. 6A, cylinder port 22 outputs the air pressure within cylinder 7 below piston 5 to the control port of low pressure (LP) valve 24. Alternatively, rather than by cylinder port 22, the air pressure of cylinder 7 can be ported through the body of valve 8 and output to valve 24 from an output port on valve 8. In a specific embodiment low-pressure valve 24 is set to open and allow the high-pressure air from port 1 to flow to port 2 when a pressure of 3 psi or lower is inputted to the control port of valve 24. Upon the receipt of low pressure at the control part of LP valve 24, LP valve 24 opens between port 1 and port 2 allowing high pressure air from port 1 to be supplied out port 2 to port 12 of 4-way valve 23. Upon receipt of high-pressure air at port 12 of valve 23, port 4 of valve 23 opens allowing high pressure (HP) air to travel out port 4 to cylinder head valve port 20. The HP air at cylinder head valve port 20 drives the valve stem over to close exhaust seat 19 and open inlet seat 18. The opening of inlet seat 18 allows air from reservoir 2 to pass through valve 8 and into cylinder 7, rapidly driving piston 5 and hammer head 12 up.

In a preferred embodiment of the '407 Patent, a needle valve 27 with an air chamber 28 is inserted in the valve system between cylinder port 22 and low-pressure valve 24. The purpose for inserting needle valve 27 with air chamber 28 is to allow the hammer head to travel all the way, or near, to the bottom of the stroke and have the desired dwell time, before allowing air to enter cylinder 7 to raise the hammer head for the up stroke. The amount of dwell time before the cycle starts again can be adjusted by adjusting needle valve 27. For example, by adjusting needle valve 27 inward, the dwell time gets longer resulting in less cycles per minute. Likewise, by adjusting needle valve 27 out the dwell time gets shorter, allowing more cycles per minute. By placing air chamber 28 between needle valve 27 and low-pressure valve 24 and adjusting needle valve 27, air chamber 28 bleeds off at a desired slower, rate. This reduced rate of pressure drop of air chamber 28 reduces the rate of pressure drop at the control port of low pressure valve 24 such as to delay the opening of port 1 to port 2 of valve 24. Accordingly, needle valve 27 can be used as a timer to adjust the dwell time and, therefore, the cycles per minute. When cylinder 7 is pressurized and the up stroke begins, cylinder port 22 allows the high pressure air to pressurize air chamber 28 and low pressure valve 24 through needle valve 27.

In a specific embodiment of the '407 Patent, the adjustment of the dwell time can be utilized to time the up stroke of the hammer head to the rebound of the object, for example piling, being driven. When a piling is struck on the top by the hammer head the piling is driven down into the ground. However, due to the elastic nature of the ground, the piling often rebounds back up and jars the hammer head. If the initiation of the up stroke is timed to begin just as the rebounding piling strokes the hammer head, some of the momentum from the rebounding piling can be transferred to the hammer head on the way up. In a typical situation, the time delay between the initial contact of the piling and the rebound contact is on the order of four milliseconds. Accordingly, the dwell can be adjusted to time the beginning of the up stroke with this rebound to enhance the efficiency of the hammer.

The use of an air operated control valve system offers superior performance compared to a mechanically controlled hammer. Mechanically controlled hammers often trigger air to enter the cylinder before the hammer head reaches the bottom of the stroke, reducing the momentum of the hammer head before contact. This reduction in momentum of the hammer head reduces the momentum transfer to the contacted object and, therefore, reduces the efficacy of the hammer.

After air is allowed to enter cylinder 7, piston 5 continues to travel up. In a specific embodiment, a limit valve 26 is utilized to detect when piston 5 reaches a certain point in the up stroke. Piston 5 continues to travel up, eventually striking the wheel on limit valve 26 part way up the hammer stroke. Limit valve 26 can be placed on an adjustable bar such that the point in the up stroke at which piston 5 strikes limit valve 26 can be adjusted. The striking of the wheel on limit valve 26 allows HP air to pass from port 1 to port 2 of limit valve 26. The HP through port 2 enters port 14 of 4-way valve 23, closing port 4 of valve 23. The closing of port 4 removes the HP air from port 20 of the cylinder head valve 8, such that spring 17 pushes inlet seat 18 closed and exhaust seat 19 open. Accordingly, no further air passes from reservoir 2 to cylinder 7 and air actually begins to exhaust from cylinder 7 through exhaust port of cylinder head valve 8.

After striking the wheel on limit valve 26, the momentum of the hammer carries it to the top of cylinder 7 where the hammer then free-falls back down to the bottom, starting the cycle all over again.

Referring to FIG. 8, illustrated is a specific embodiment of an automatic control valve system in accordance with the prior air operated hammer of the '407 Patent. This automatic control valve system is similar to the system shown in FIG. 6B and operates in basically the same way. Inserted between high-pressure air supply and each of 4-way valve 23, port 1 of low-pressure valve 24, and port 1 of limit valve 26, is a minimum pressure valve 30. In the embodiment shown in FIG. 8, minimum pressure valve 30 is set for a minimum pressure of 40 psi, such that when 40 psi is achieved, valve 30 opens allowing pressurized air to flow to 4-way valve 23, port 1 of low-pressure valve 24, and port 1 of limit valve 26. When the hammer head is at rest and there is essentially no pressure in cylinder 7, valve 24 is open such that air can flow through to port 12 of valve 23 causing port 4 of valve 23 to open such that air flows into port 20. Pressurized air flowing into port 20 causes valve 18 to open, injecting high pressure air into cylinder 7 which accelerates the hammer head upwards. The upward moving hammer head triggers exhaust valve 26, for example by striking the trigger mechanism of valve 26, which directs pressurized air to port 14 of valve 23. Pressurization of port 14 of valve 23 shuts off and bleeds down port.4 of valve 23, causing the hammer head to fall under gravity. When low pressure valve 24 senses the threshold pressure, for example 3 psi or less, port 2 of valve 24 opens to shuttle port 12 of valve 23.

Still referring to the embodiment shown in FIG. 8 of the '407 Patent, to keep low-pressure valve 24 from sensing 3 psi prematurely, causing excessive blows per minute, needle valve 27 and hose coil 28 can be placed between cylinder port 22 and low-pressure valve 24. Note that cylinder port 22 enters cylinder head 10 and is channeled into cylinder 7, for the embodiment shown in FIG. 8. When cylinder 7 is pressurized and the upstroke of the hammer head occurs, cylinder port 22 pressurizes hose coil 28 and low-pressure valve 24 through needle valve 27. When the exhaust stroke occurs, needle valve 27 functions to cause the air pressure from hose coil 28 and low-pressure valve 24 to bleed off at a desired rate, preferably slowly, such that pressure is maintained even after cylinder 7 has no pressure.

During the operation of the embodiment shown in FIG. 8, the pressurized air supply, for example, an air compressor, should preferably maintain a pressurized air pressure of at least 110 psi. This helps to ensure proper operation of the valving system. As an example, a 185 cfm compressor can be set at 120 psi to hold a steady 110 psi during operation. Preferably, the pressurized supply is delivered by a 1" diameter hose no longer than 100' long. A gate valve, rather than a ball valve, is preferably used between the compressor and oiler to control the flow. Ball valves can be hard to adjust and preferably are used only to start and stop hammer operation. Once the gate valve is set for a particular air compressor, re-adjustment is typically necessary. To increase the number of blows per minute, needle valve 27 can be opened, i.e., turned counterclockwise. To decrease the number of blows per minute, needle valve 27 can be closed, i.e., turned clockwise. To increase the length, or height, of the stroke, exhaust valve 26 can be moved up. To reduce stroke height, exhaust valve 26 can be lowered. Small adjustments at a time are preferred for both valve adjustments. The stroke height and number of blows per minute can be difficult to maintain at a constant stroke height and speed when the gate valve delivers too much air to hammer. Accordingly, the valve can be gradually closed to reduce flow. After about 5 to 8 blows, further adjustments can be made. If the hammer hits several blows at the same rate and then misses or slows a few beats, gate valve can be opened a little at a time in order to increase the flow. Readjustment of the stroke height (exhaust valve 26) and the number of blows per minute (needle valve 27) may have to be made several times for optimum performance. In a specific embodiment of the '407 Patent, full stroke at 53 to 60 blows per minute is ideal.

In a specific embodiment of the '407 Patent, the pipe frame of the hammer can serve as a pressurized air reservoir. With respect to this embodiment, air can be bled off and water and/or dirt in the pipe frame can be disposed of by opening petcocks on the pipe frame. Other gases can be used to supply the pressurized gases needed for the air-operated hammer of the '407 Patent.

In a specific embodiment of the '407 Patent, the subject air-operated hammer can be designed to utilize interchangeable heads for different tasks, including pile hammering, demolition, forging, and compacting. For example, for demolition the hammer can have a wedge head for breaking concrete and for compacting the hammer can have a large surface flat plate. These heads can be interchanged depending on the use.

In a further embodiment of the air-operated hammer of the '407 Patent, a two-stroke hammer can be implemented where pressurized air can be allowed to enter cylinder 7 on top of piston 5 during the down stroke of the hammer head. The use of pressurized air on the down stroke in this way can increase the momentum of the hammer head and therefore increase the impact of each hammer stroke. A second valve similar to valve 8 can be utilized to control the flow of pressurized air into and out of cylinder 7 above piston 5. Additional control valving can then be used to coordinate the two valves to optimize the timing of the two strokes of the hammer. Reservoir 2 can supply air for both strokes or a second separate reservoir can be utilized for the down stroke.

In a specific embodiment of the air-operated hammer of the '407 Patent, an acceleration detector can be utilized to measure the deacceleration of the hammer head upon striking an object. This detector can be used, for instance if the hammer is being used to drive pilings and each piling is supposed to be driven in to a particular equivalent inertia. Accordingly, when a certain deacceleration of the hammer head is achieved upon impact, the operator can stop.

Referring to FIGS. 1A and 2A, and considering an embodiment of the hammer of the '407 Patent having the volume between cross members 4*a* and 4*b* enclosed by wall 37 creating a cavity which is used as a pressurized air reservoir to augment pressurized air reservoir 2, it is advantageous for the volume of pressurized air reservoir 2 to be larger than the volume of cylinder 7. Preferably, the volume of pressurized air reservoir 2 is at least twice as large as the volume of cylinder 7, more preferably at least three times as large, and even more preferably at least four times as large. Having a large volume reservoir 2 relative to the volume of cylinder 7, allows reservoir 2 to supply air to cylinder 7 at a high rate and can allow air to be supplied at a much higher rate than the compressed air supply can provide.

Referring to FIG. 9, an embodiment of the air-operated hammer of the '407 Patent which incorporates bounce chamber 41 and shock bushings 50 is shown. For clarity and ease of discussion the following are also: referenced: cylinder head 39, air exhaust apertures 42, cylinder 43, reservoir 44, piston 45, valve 46, rod 47, hammer housing 48, hammer 49, floating plate 51, bell assembly 52, and input aperture 53.

As piston 45 starts the up-stroke of the hammer, air in cylinder 43 above piston 45 is compressed by piston 45 and exits air exhaust apertures 42. However, once piston 45 passes apertures 42 the air remaining in cylinder 43 cannot exit apertures 42. The portion of cylinder 43 above apertures 42 is referred to as a bounce chamber 41. Bounce chamber 41 can allow the trapping of air as piston 45 is raised past air exhaust apertures 42. As this trapped air is further compressed, it exerts a force on piston 45 which tends to slow the upward motion of piston 45 and, therefore, hammer 49. The compressed air in bounce chamber 41 also pushes up on cylinder head 39 so as to support a portion of the weight of the entire hammer apparatus.

In a specific embodiment of the '407 Patent, the size of bounce chamber 41 can be selected with respect to the other parameters of the hammer apparatus, so that the air compressed in the bounce chamber 41 actually lifts the entire hammer apparatus. In this way, the weight of the hammer apparatus can assist the next hammer blow. As the lifted hammer apparatus starts to fall, the top of bounce chamber 41 pushes on the air in the bounce chamber so that the air compressed in the bounce chamber 41 can push the top of the piston down to initiate the down stroke of the hammer so as to contribute to the downward momentum of the hammer. In this way, the air compressed in the bounce chamber can act as sort of a spring. In addition, the size of bounce chamber 41 can be dependent on the location where the hammer is used. For example, the size for a hammer to be used in Florida, near sea level, might be different than for a hammer to be used in Colorado, well above sea level.

Referring again to FIG. 9, shock bushings 50 are shown which can be incorporated with the subject hammer to, for example, reduce wear and tear. In the embodiment shown in FIG. 9, two lower shock bushings are shown. If desired, four, or more, such bushings 50 can reside near the bottom of hammer housing 48. Without these bushings when floating plate 51 is raised above, for example, a pile, and hammer 49 hits floating plate 51, floating plate 51 can reach the bottom of bell assembly 52 and cause bell assembly 52 to contact housing 48. Without bushings 50, the contacting of housing 48 by bell assembly 52 in this situation can cause damage to the housing 48, such as cracking. The hitting of bell assembly 52 by floating plate 51 can result because floating plate 51 floats within slots in bell assembly to keep floating plate properly 51 positioned. These bushings 50 can reduce damage to the housing by coupling the lower portion of hammer housing 48 and bell assembly 52 so as to provide some give to allow, housing 48 and bell assembly 52 to approach each other when hammer 49 hits floating plate 51 and floating plate 51 hits, for example, a pile.

In an alternative embodiment of the '407 Patent, floating plate 51 can be extended out to attach to shock bushings 50. This embodiment can be useful for busting concrete, where a pin attached to hammer 49 travels through an aperture in floating plate 51 to contact the concrete. Accordingly, shock bushings 50 can couple the lower portion of hammer housing 48 to floating plate 51 so as to allow some given when hammer 49 hits floating plate 51. The use of the lower shock bushings 50 can thus save wear and tear on the lower portion of hammer housing 48 and the entire hammer apparatus.

The top shock bushing shown in FIG. 9 can couple the lower end of rod 47 to hammer 49 in order to provide give between rod 47 and hammer 49 when hammer 49 hits floating plate 51. Again, this shock bushing reduces wear and tear of the hammer apparatus.

In a specific embodiment of the air-operated hammer of the '407 Patent, the air input to the chamber to raise the piston and the control of the air exhausting from the chamber can be separately controlled. For example, two valves controlled by two corresponding solenoids can be used. In this way, a first valve can open to allow air to flow into the chamber to raise the piston. Once enough air has entered the chamber to raise the piston the desired height or provide the desired momentum, the first valve can be closed. The compressed air in the chamber can then continue to expand and continue to raise the piston while the valve controlling the exhaust is still closed, if desired. Once the piston has reached a point where opening the exhaust valve will not adversely affect the operation of the hammer apparatus, the exhaust valve can be opened. In a specific embodiment, referring to the hammer apparatus shown in FIG. 9, the exhaust valve can be opened when the bounce chamber 41 reaches a desired pressure. This would be efficient in the sense that the exhaust valve is closed when air is entering from the reservoir into the chamber and while the air in the chamber is expanding after closing the air input valve, and the exhaust valve is opened once the piston is about to start, is starting, or has just started, the downward stroke, as desired.

In the '407 Patent, the exhaust valve can remain open allowing air to exit the chamber while the piston is traveling down. The air input valve can stay closed during the down stroke of the piston as well. Once the piston is nearing floating plate to input energy to the desired target, is hitting the floating plate, or has just hit the floating plate, the exhaust valve can be closed. Once the exhaust valve is closed, or simultaneously with closing the exhaust valve, the air input valve can then be opened to start a new stroke. Of course, by adjusting the amount of time the air input valve is open, the pressure in the bounce chamber which triggers the openings of the exhaust valve (note the opening of the exhaust valve can be triggered by other means such as a switch trigger at a certain height of the piston), and the delay between the piston striking the floating plate and the opening of the air input valve, a variety of parameters with respect to the subject hammer can be controlled. These include the length of the stroke (and therefore the force of the blow), the assistance provided by the bounce chamber, and the number of strokes per time. As mentioned, the triggering of the opening and closing of the air input valve and exhaust valve can be based on a variety of input, such as a period of time after another event, pressures in different portions of the chamber, and the height and direction of the piston.

The hammer of the '407 Patent can utilize electrical power, for example from 12, 24, and/or 28 volts DC and/or 24, 120, and/or 230 volts AC, to operate solenoids which control the valve controlling the air into the chamber and/or the air exhausting from the chamber. FIG. 10 shows a digital time delay module which can be utilized with the air-operated hammer of the '407 Patent. By adjusting the time delay module and the solenoid coils, a desired voltage can be achieved. The operator can manually control the air control solenoids by adjusting the time delay module, in order to change the number of strokes per minute. Such adjustments can be made by varying the up and down external time delay adjustments in the time delay module. The length of the stroke can be changed by adjusting the amount of air allowed to enter the chamber. The length of the stroke can determine the force of the blow struck by the piston.

This device of the '407 Patent can be used to break-up concrete roadways. In a specific embodiment, several individual hammer apparatus can be used as one unit and controlled by, for example a computer, to achieve sequential vibration free striking, similar to the timing and firing of a piston engine. The operator, through the computer program, may control the length and timing of the striking sequence in each device in the unit in order to maximize the effectiveness of each strike and reduce wear and tear on the equipment.

It is preferable for the reservoir to be large enough in relation to the chamber to throw the piston up to the desired height of the stroke. Also, it is desirable for the reservoir to be able to sustain its pressure while pushing the piston up. It is desirable for the reservoir to be able to provide air to throw the piston up and then refill during the rest of the up stroke and the down stroke of the piston. In addition, as with the embodiment of the '407 Patent shown in FIG. 9, it is desirable for the reservoir to be able to throw the piston up such that a portion of the pistons upward momentum can be stored as compressed air in the bounce chamber 30 as to help assist the piston at the initiation of the down stroke. Accordingly, it is preferable for the reservoir to be at least 2-3 times as large, and even more preferably at least 4-5 times as large. Preferably, the reservoir can supply the air input needs without reliance on the compressed air coming from the compressed air source, although the reservoir can continue to receive air during the time the air input valve is open. Preferably, a sufficient amount of air to raise the piston to the desired height can be inputted into the chamber during less than 50% of the height of the piston stroke, more preferably less than 30% of the height of the piston stroke, and even more preferably less than 15% of the height of the piston stroke.

The size of the compressed air source can be selected, based on the parameters of the hammer apparatus, such that the compressed air source can replenish the reservoir with the amount of air used during the time the air input valve is open, during the length of time of the stroke. Of course, an appropriate amount of extra capacity can be factored in.

To overcome the shortcomings of prior air-operated hammers, such as those of the '407 Patent described above, the present disclosure pertains to an improved air-operated hammer which can utilize a flexible and adjustable pressurized air reservoir comprising a flexible and adjustable air hose located on the frame of the hammer which can be replaced with flexible and adjustable air hoses of different sizes to provide different sized air reservoirs as needed.

Unlike prior air-operated hammers, the flexible/adjustable pressurized air reservoir of the present disclosure can continue to receive pressurized air from a compressed-air source even when the hammer head is falling. Preferably, the reservoir can enable pressurized air to enter the cylinder of the hammer at a faster rate than the hammer's compressed-air source can supply. The hammer's compressed-air source can be located external to the hammer such that the source delivers air through, for example, a high-pressure air hose.

According to the present disclosure, the subject hammer can be modular with various components thereof mounted on the outside of the frame, such as the flexible/adjustable pressurized air reservoir and/or the air manifold and air control valve, to allow the air-operated hammer to be customized for particular applications.

BRIEF SUMMARY OF THE DISCLOSURE

In a preferred aspect, the present disclosure comprises an air-operated hammer, comprising: a hollow ram; a frame; an air cylinder and piston assembly disposed within the rain, wherein a top of the cylinder and piston assembly is attached to a top of the frame and wherein a piston rod of the cylinder and piston assembly is attached to a bottom of the ram; an air flow control valve mounted on and in fluid communication with a manifold disposed on a top of the frame; a first pressurized air reservoir comprising a first flexible hose of a first size attached to an outside surface of the frame, wherein lifting of the ram is caused by pressurized air from the pressurized air reservoir being supplied to and entering a bottom of the cylinder, wherein pressurized air entering a bottom portion of the cylinder causes the piston to raise the ram.

In another preferred aspect of an air-operated hammer of the present disclosure, the first flexible hose of the first size has been replaced with a second flexible hose of a second size to provide a second pressurized air reservoir of the second size.

In yet another preferred aspect, the air-operated hammer of the present disclosure further comprises an upper limit switch attached to an upper portion of the frame and lower limit switch attached to the frame below the upper limit switch.

In another preferred aspect, the air-operated hammer of the present disclosure further comprises a dwell-adjustment air tube connected in fluid communication between the lower limit switch and the air flow control valve for regulating dwell time of the ram at a bottom travel limit of the ram.

In a further preferred aspect of an air-operated hammer of the present disclosure, the dwell-adjustment air tube is adjustable for adjusting the dwell time of the ram at a bottom travel limit of the ram.

In yet another preferred aspect, the air-operated hammer of the present disclosure further comprises one or more downstroke assist air tubes connected in fluid communication between the airflow control valve and respective one or more air inlets in a cylinder head of the cylinder for supplying pressurized air into the cylinder above the piston to assist in forcing the ram downward during a downstroke of the ram while pressurized air below the piston is allowed to flow through the airflow control valve and into the cylinder above the piston.

DETAILED DESCRIPTION

Figure 1B:
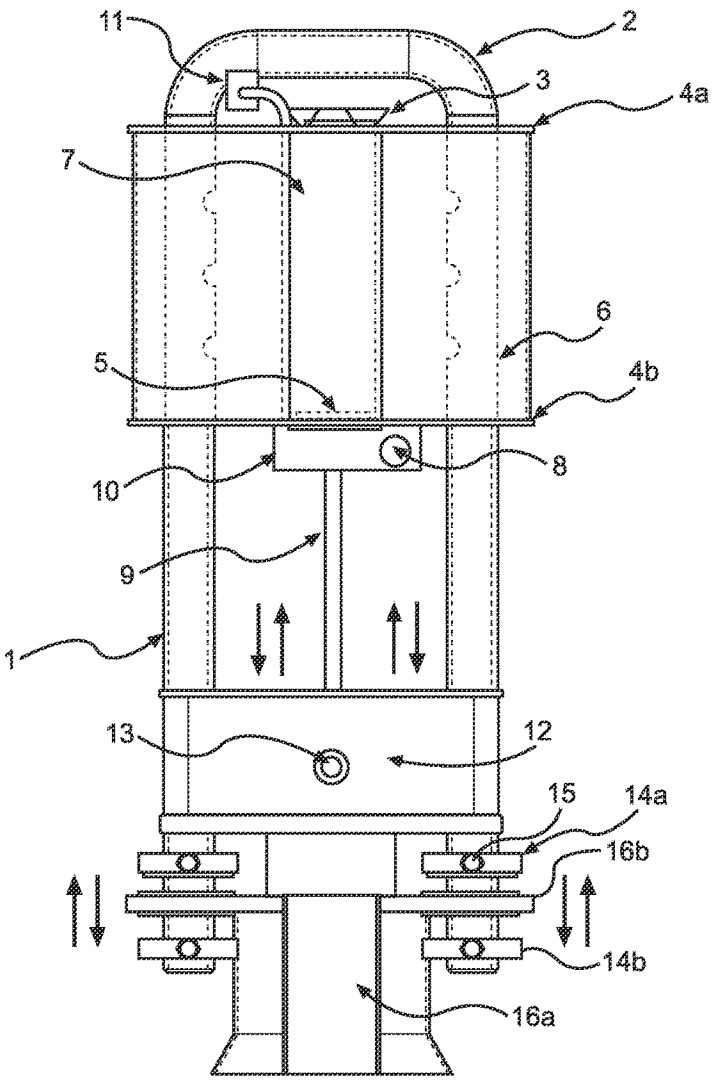
FIG. 1B (Prior Art)
FIG. 1B shows a front view of a specific embodiment of a prior art air-operated hammer of the '407 Patent, with the hammer head in the down position.
Figure 1A:
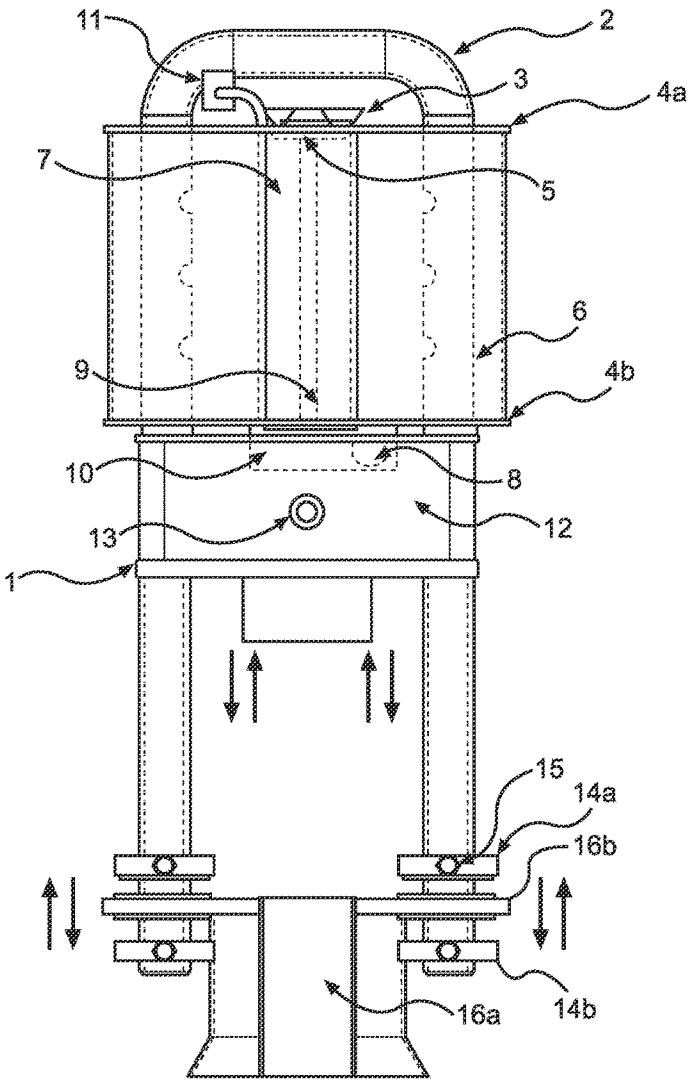
FIG. 1A (Prior Art)
FIG. 1A shows a front view of a specific embodiment of a prior art air-operated hammer, with the hammer head in the up position, as disclosed in U.S. Pat. No. 6,619,407 issued Sep. 16, 2003 (the "'407 Patent).
Figure 2A:
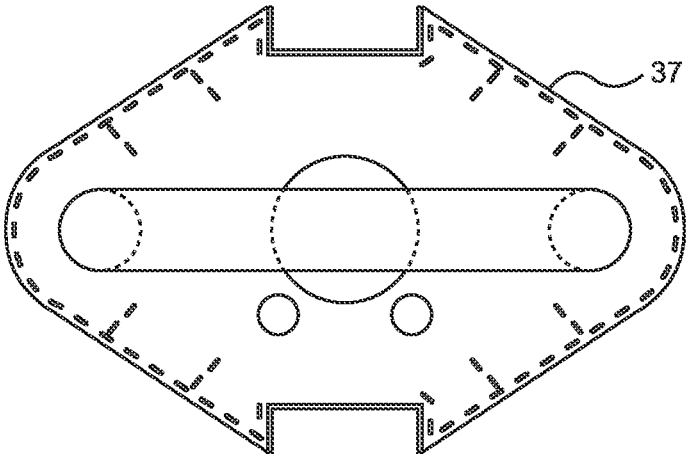
FIG. 2A (Prior Art)
FIGS. 2A and 2B show a top view of the prior art air-operated hammer of FIGS. 1A and 1B, respectively.
Figure 2B:
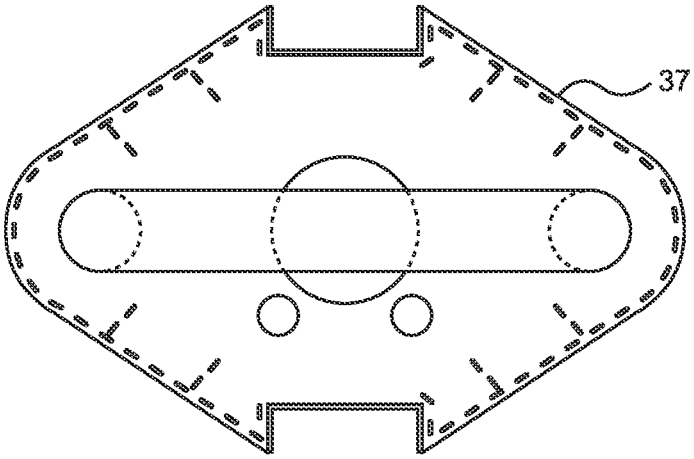
FIG. 2B (Prior Art)
Figure 3A:
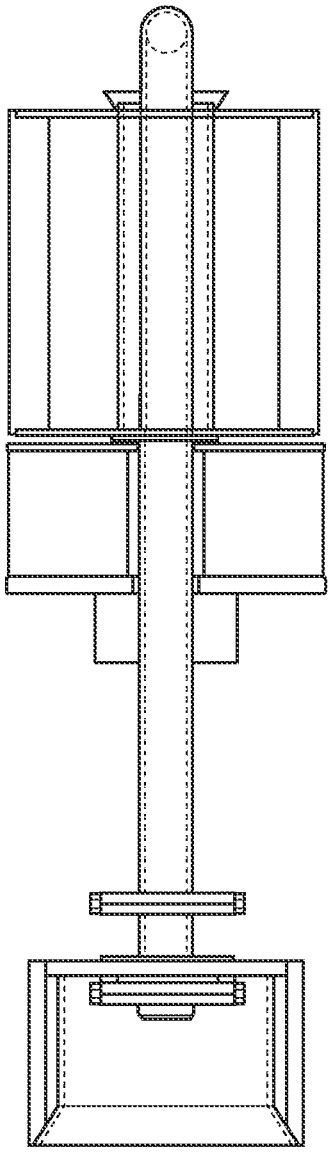
FIG. 3A (Prior Art)
FIGS. 3A and 3B show side views of the prior art air-operated hammer of FIGS. 1A and 1B, in the hammer-head up and down positions, respectively.
Figure 3B:
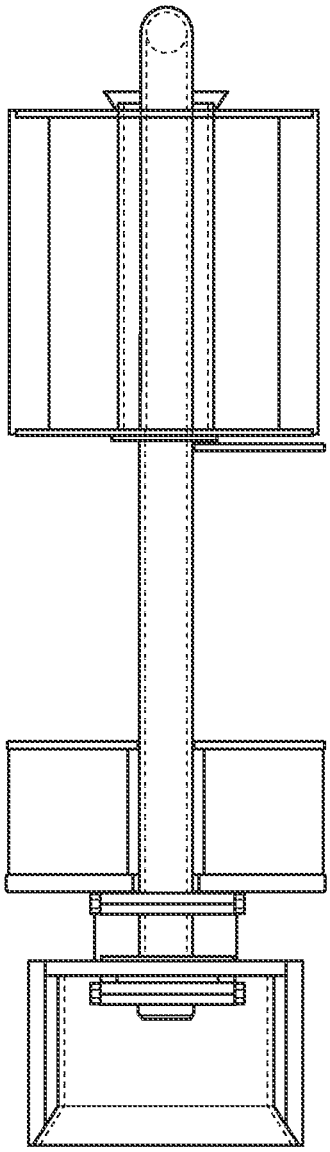
FIG. 3B (Prior Art)
Figure 4A:
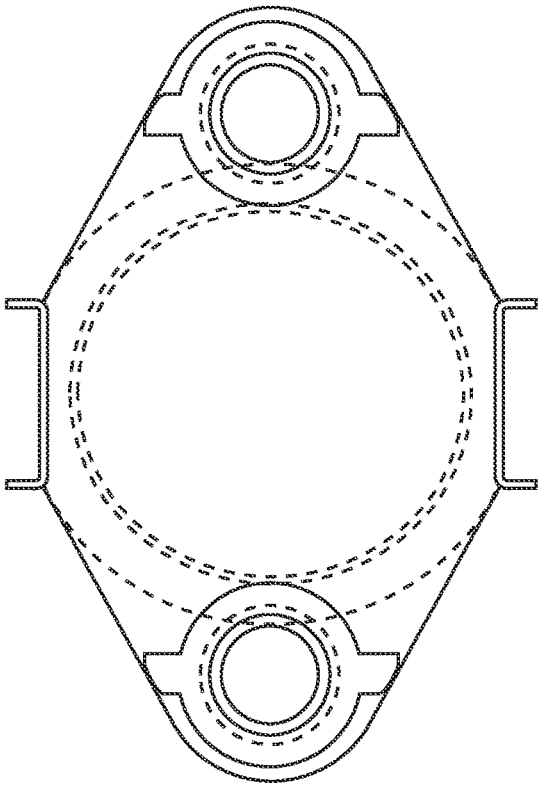
FIG. 4A (Prior Art)
FIGS. 4A and 4B show a bottom view of the anvil skirt and anvil of the prior art air-operated hammer of FIGS. 3A and 3B, respectively.
Figure 4B:
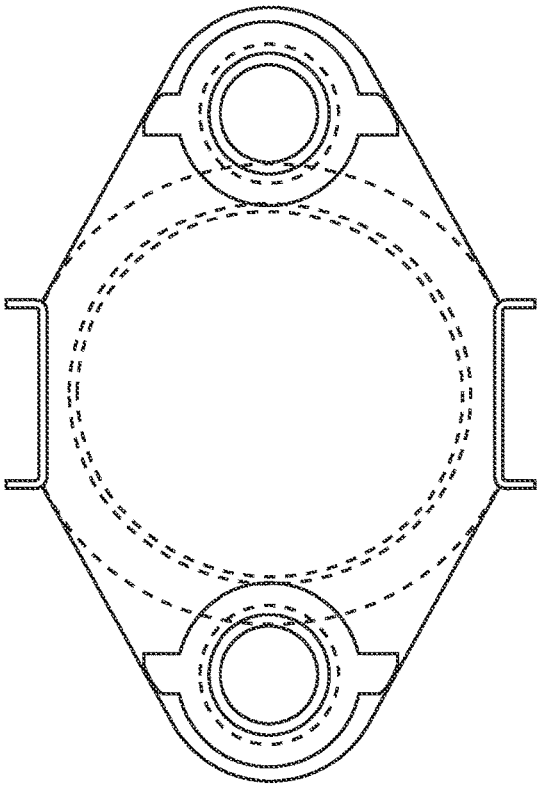
FIG. 4B (Prior Art)
Figure 5A:
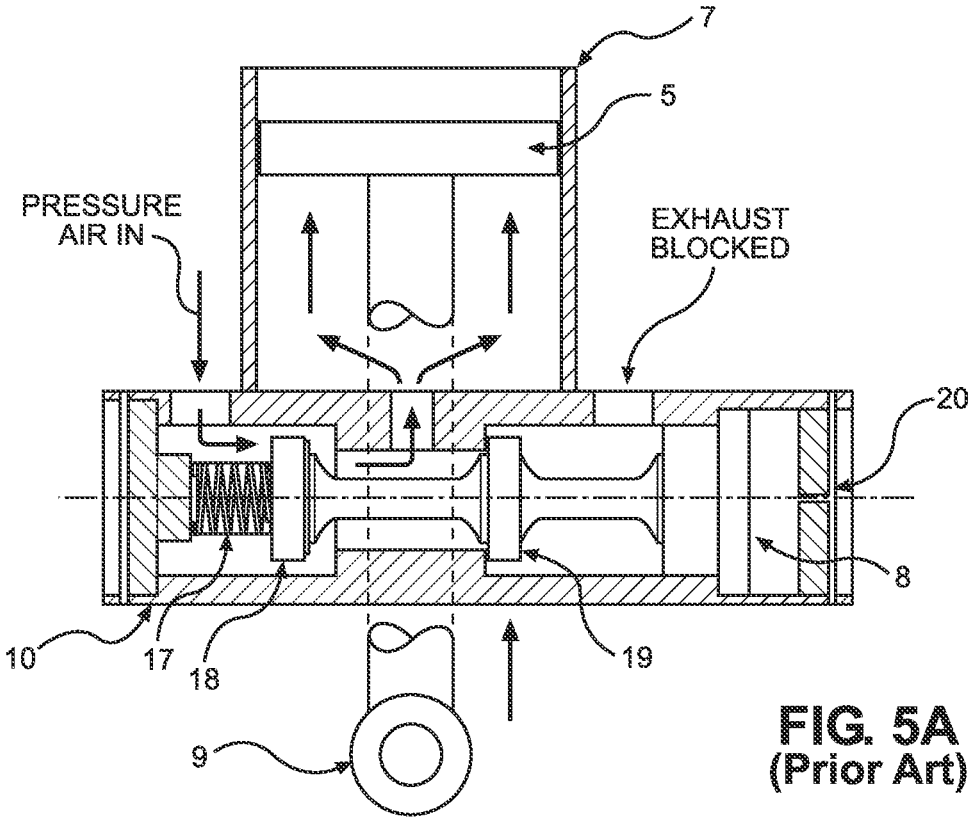
FIG. 5A (Prior Art)
FIGS. 5A and 5B show a specific embodiment of a prior art automatic control valve for an air-operated hammer, in the inlet air open position and inlet air closed position, respectively, in accordance with the '407 Patent.
Figure 5B:
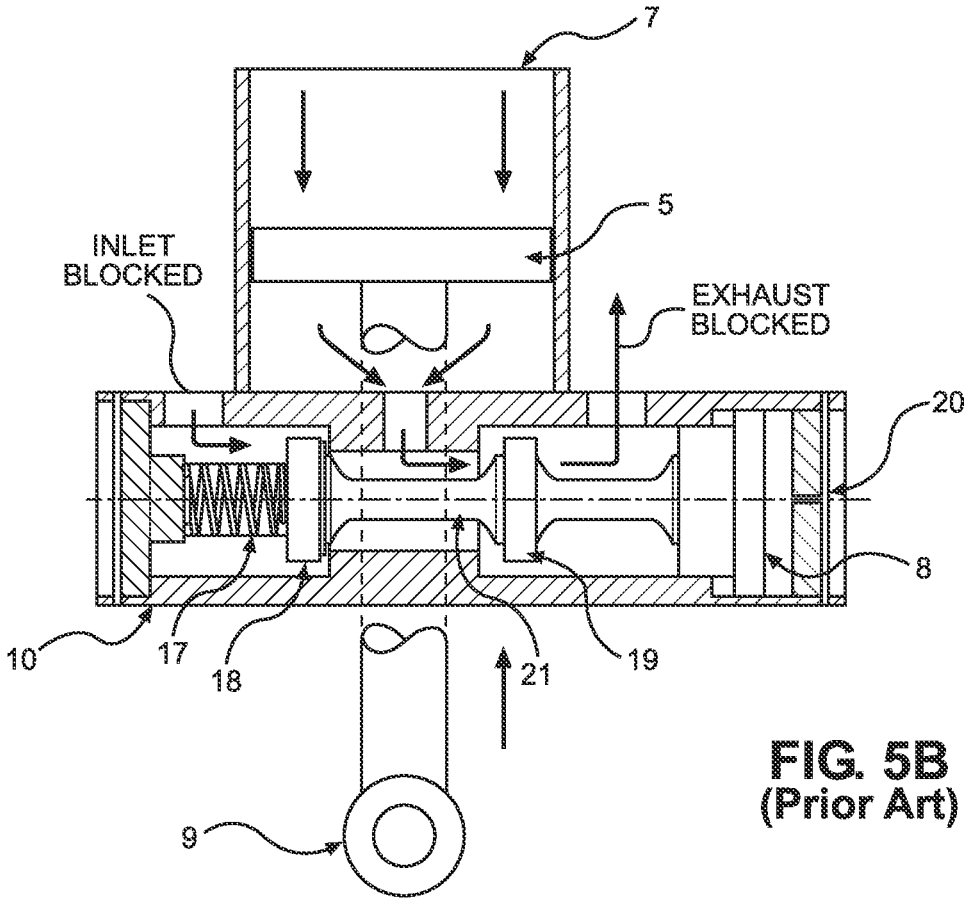
FIG. 5B (Prior Art)
Figure 6A:
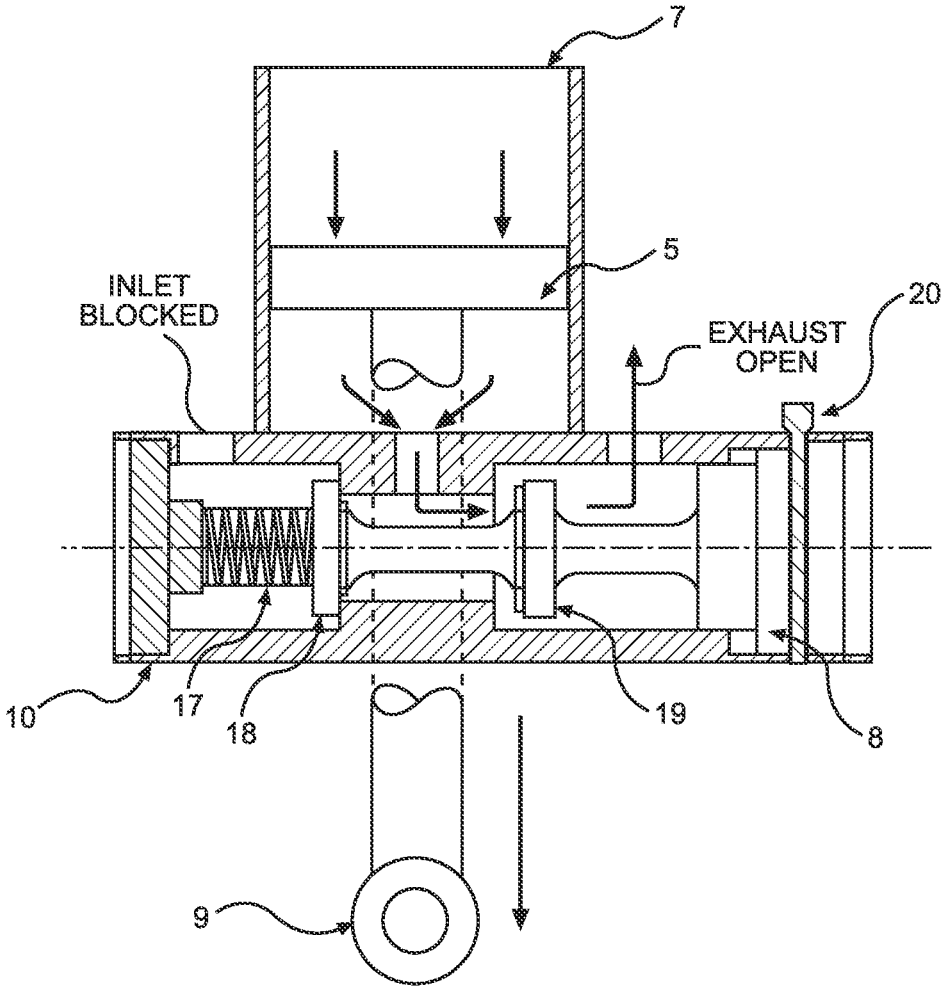
FIG. 6A (Prior Art)
FIGS. 6A and 6B show a specific, embodiment of a prior art automatic control valve system for an air-operated hammer in accordance with the '407 Patent.
Figure 6B:
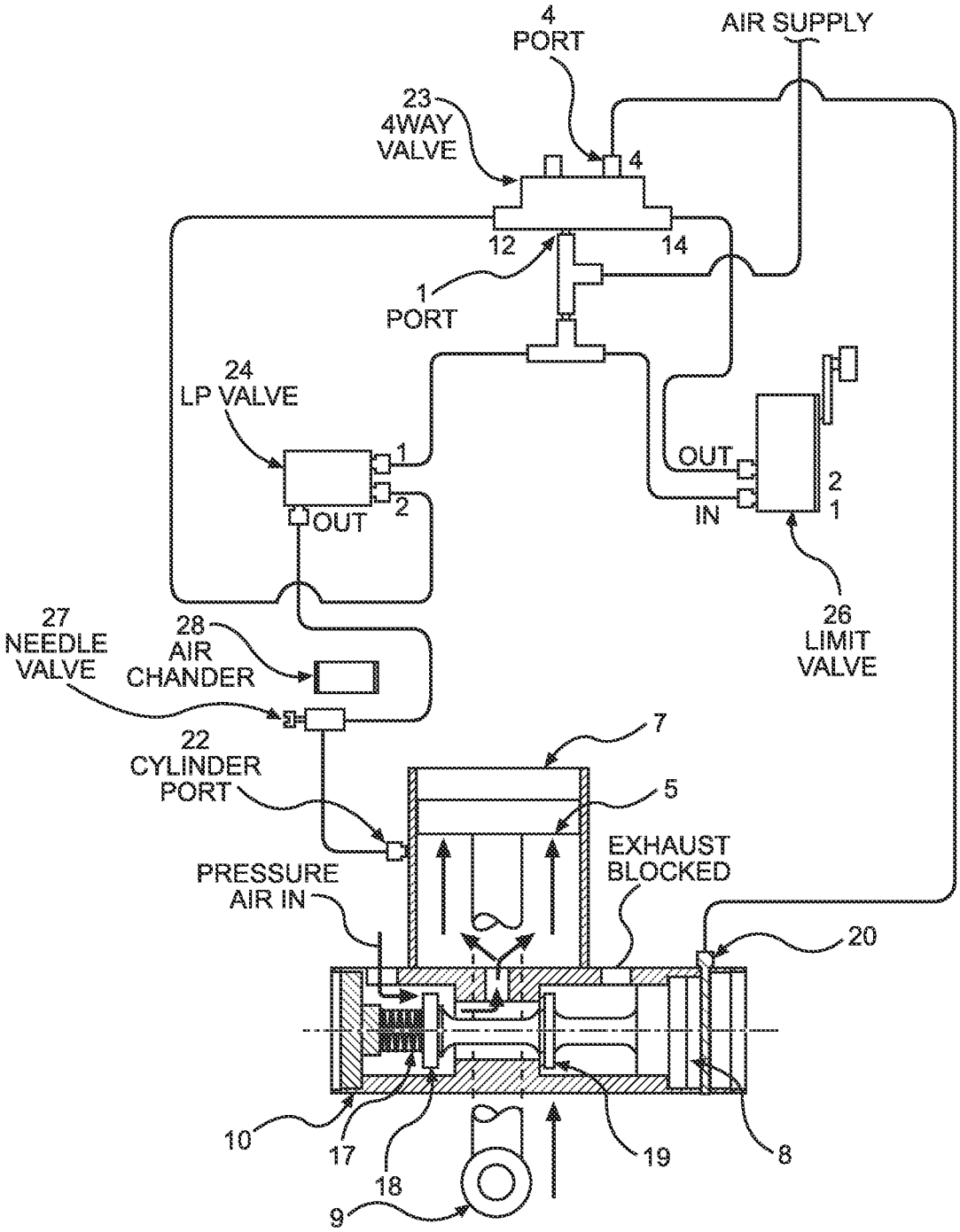
FIG. 6B (Prior Art)
Figure 7:
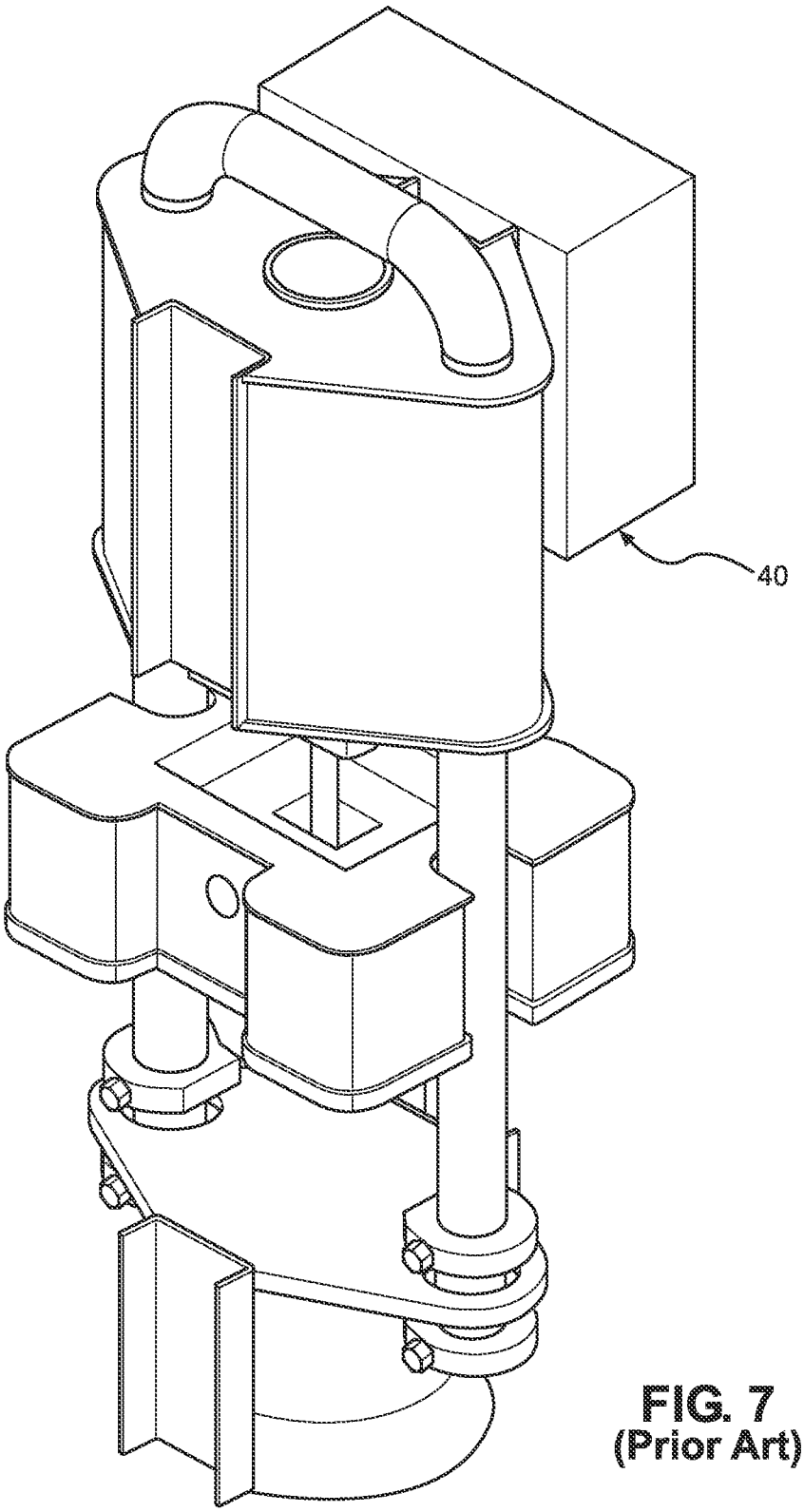
FIG. 7 (Prior Art)
FIG. 7 shows a perspective view of a specific embodiment of a prior art air-operated hammer of the '407 Patent.
Figure 8:
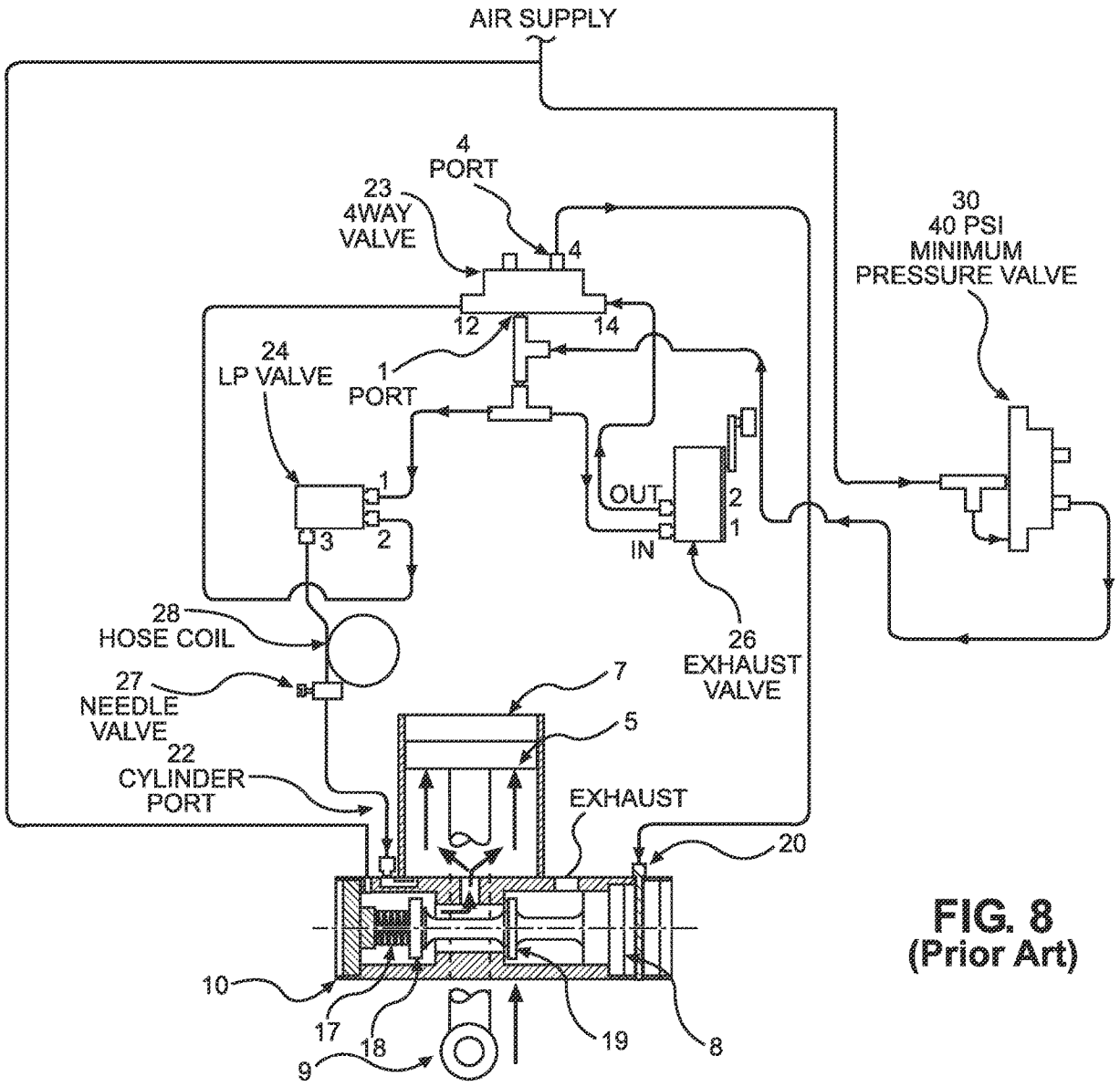
FIG. 8 (Prior Art)
FIG. 8 shows a specific embodiment of a prior art automatic control valve system for an air-operated hammer in accordance with the '407 Patent.
Figure 9:
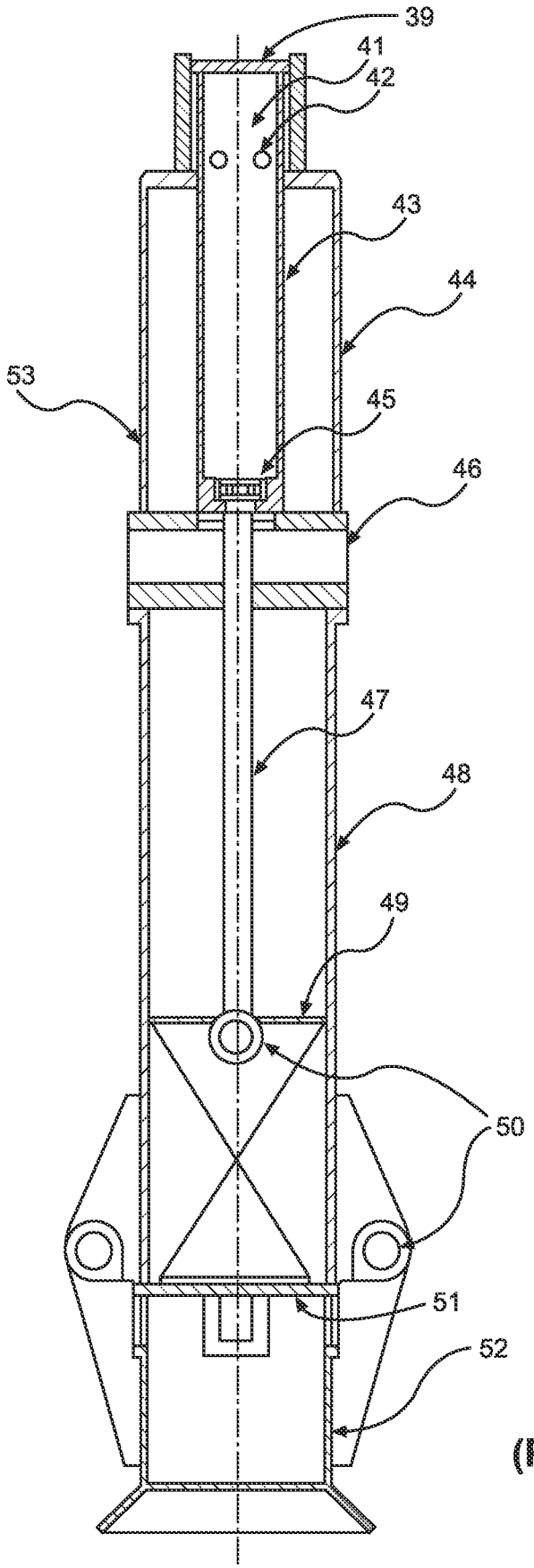
FIG. 9 (Prior Art)
FIG. 9 shows a specific embodiment of a prior art air-operated hammer which incorporates a bounce chamber and shock bushings in accordance with the '407 Patent.
Figure 10:
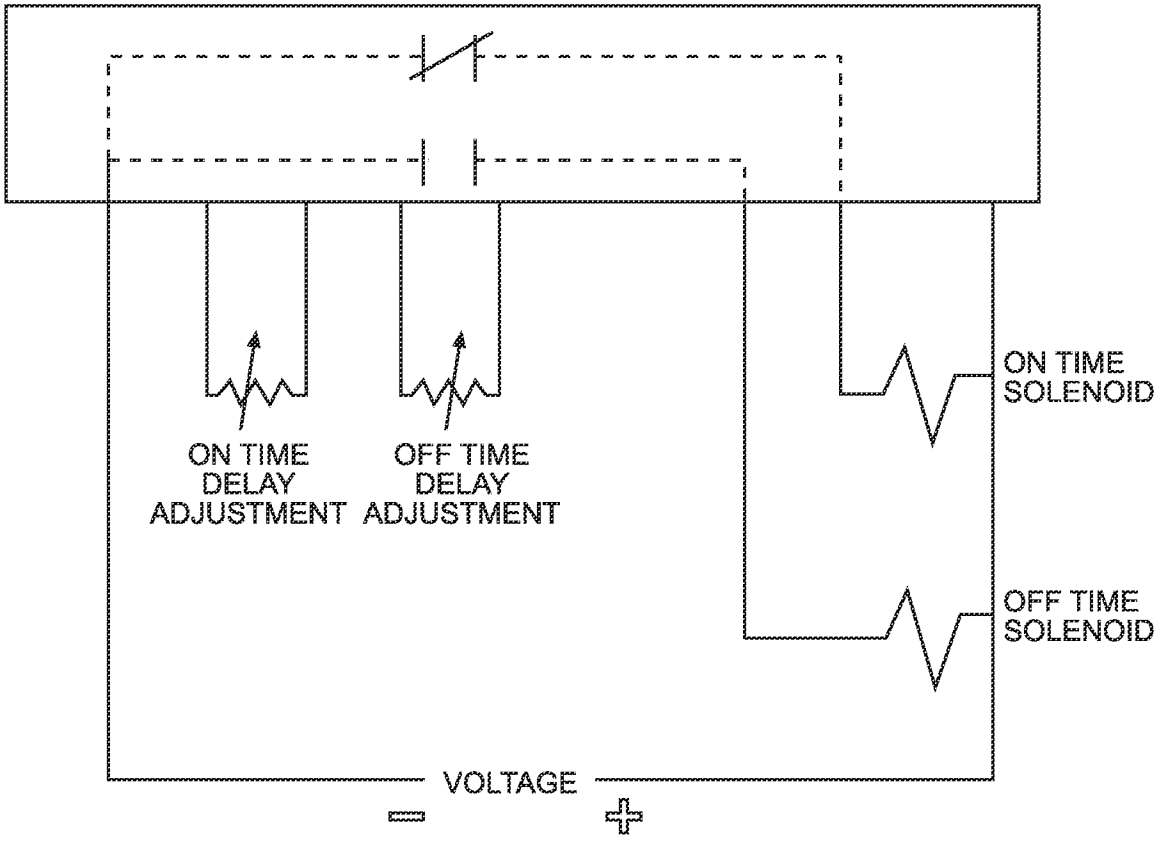
FIG. 10 (Prior Art)
FIG. 10 shows a specific embodiment of a prior art digital time delay module for an air-operated hammer which can be utilized in accordance with the '407 Patent.
Figure 11:
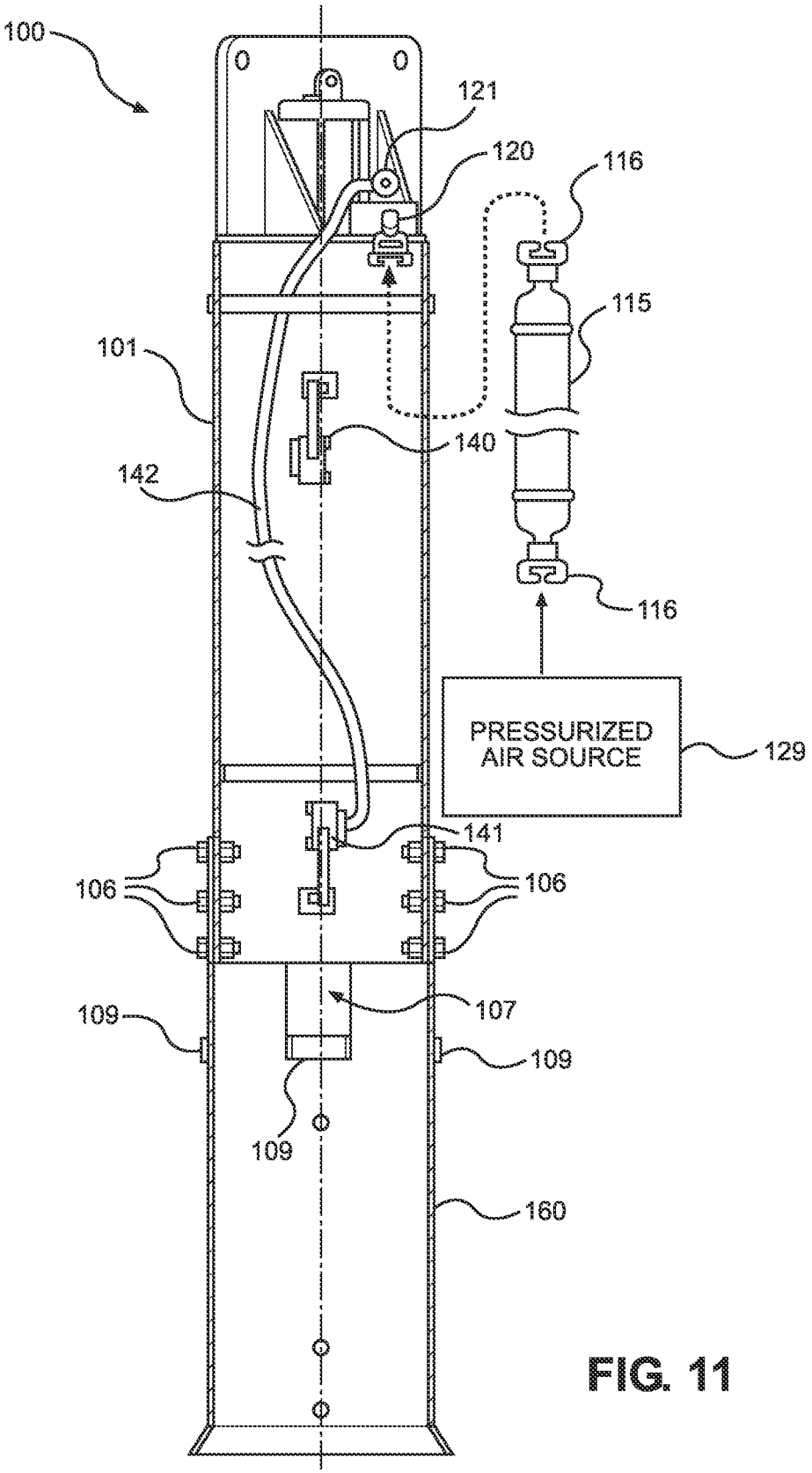
FIG. 11 shows a preferred embodiment of an air-operated hammer of the present disclosure.
Figure 12:
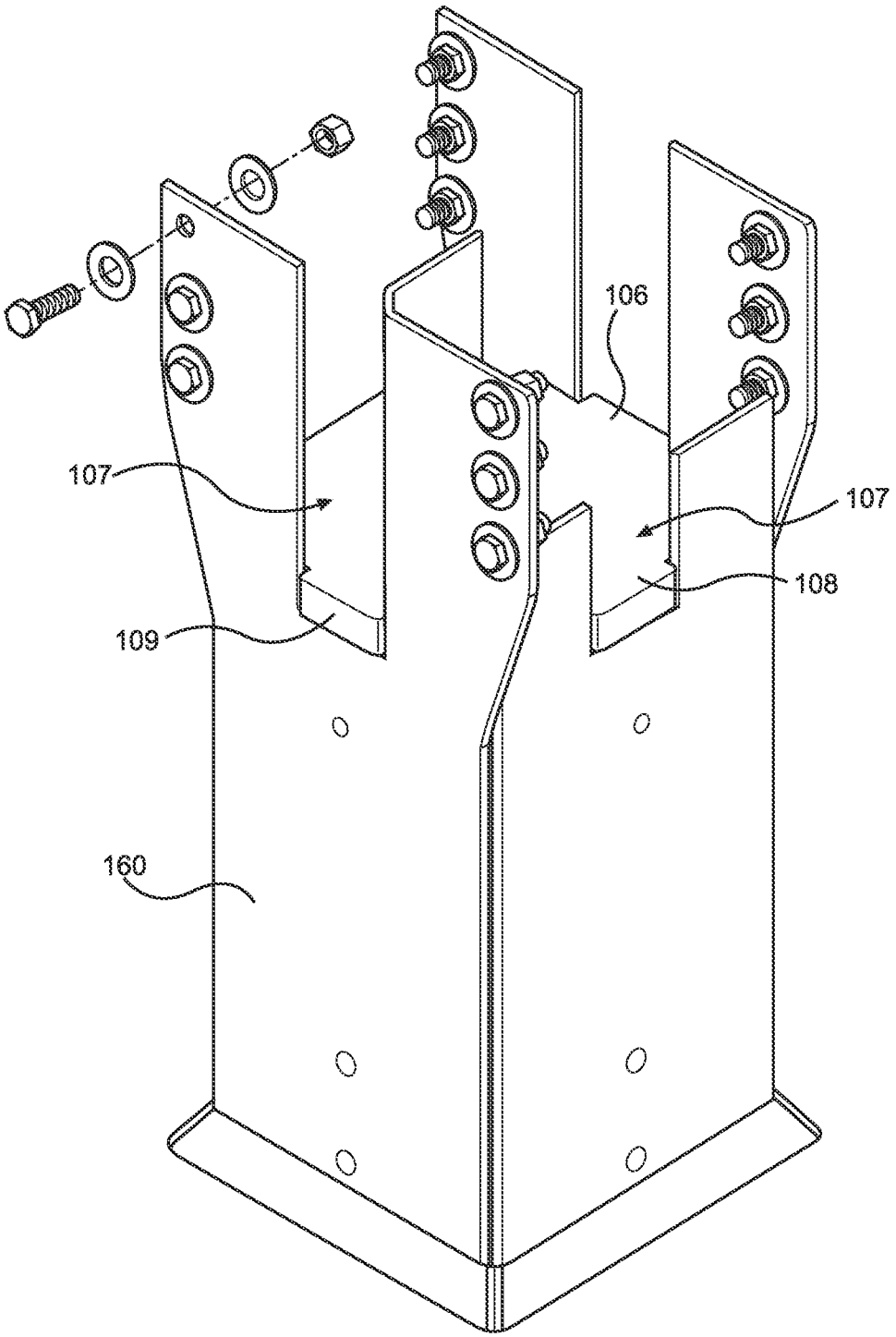
FIG. 12 shows a preferred embodiment of a lower frame component of the air-operated hammer of FIG. 11.
Figure 14:
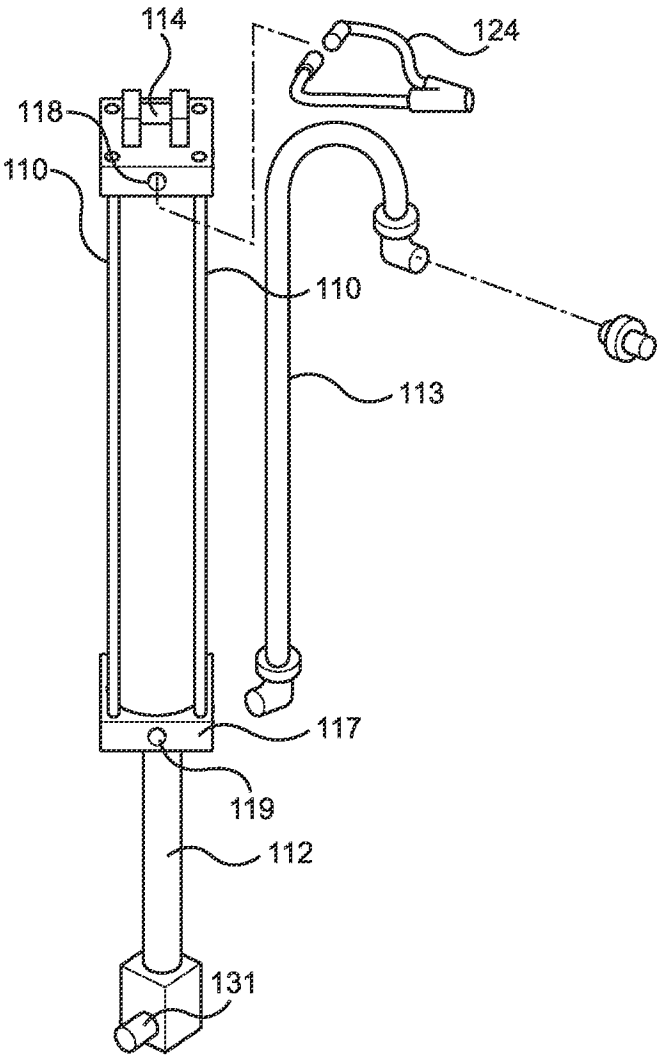
FIG. 14 shows a preferred embodiment of an air cylinder of the air-operated hammer of FIG. 11.
Figure 13:
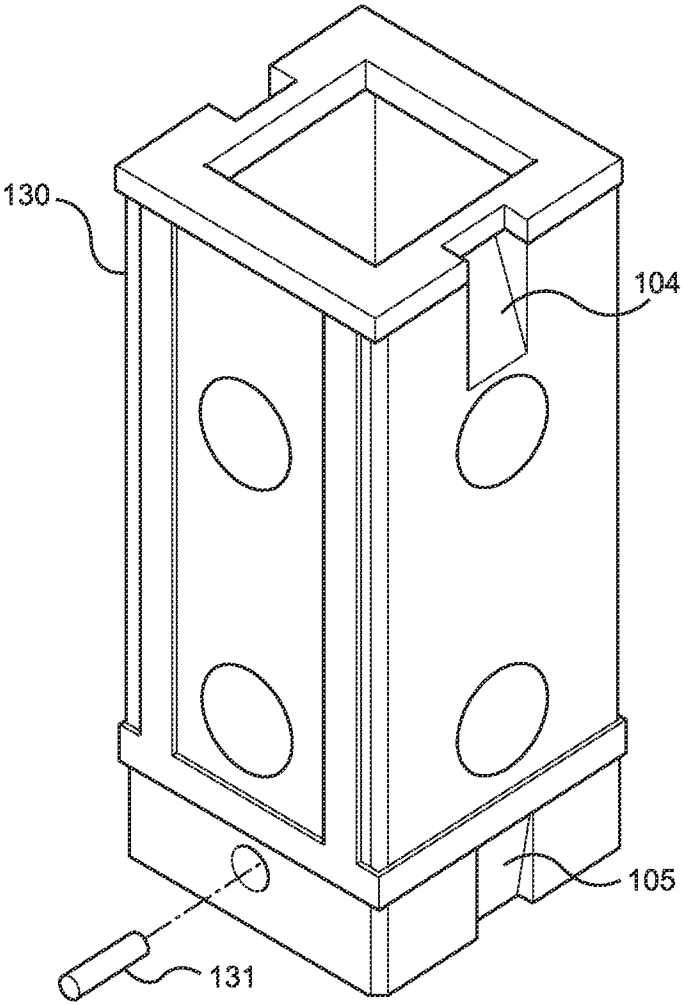
FIG. 13 shows a preferred embodiment of a ram of the air-operated hammer of FIG. 11.

FIGS. 11-16 show a preferred embodiment of an air-operate hammer 100 of the present disclosure. Air-operate hammer 100 comprises an upper housing or frame 101 and a lower bell 160. Preferably, upper housing 101 and bell 160. Are attached with bolts 106, but such unit could also preferable made of one piece or multiple other pieces as needed. A hollow ram 130 fits within upper housing 101 and bell 160 for reciprocating linear motion therewithin. Preferably, ram 130 is designed to hit striker plate 108 at the end of its downstroke. Striker plate 108 has tabs 109 that are disposed in slots 107 in bell 160 as shown in FIG. 12. Tabs 109 act to maintain striker plate 108 at the proper orientation within bell 160. Air-cylinder 110 and piston 112 are preferably disposed within hollow ram 130 with a pin 131 connecting the piston rod 112 to the bottom of ram 130 which allows for a lower overall height of hammer 100. Cylinder base 117 preferably has a pressurized air inlet 119 for receiving pressurized air from hose 113 from manifold 120 and main valve 121 for lifting piston 111 and ram 130 within bell 160 and upper housing 101. Manifold 120 and valve 121 preferably receive pressurized air from flexible pressurized air reservoir 115 via connectors 116 and 122. Pressurized air reservoir 115 preferably comprises flexible and adjustable hose of a 1 inch to 3-inch diameter connected to a pressurized air source via a connector 116. Preferably, pressurized air reservoir 115 which is made from a flexible hose or tubing whose length can be changed by replacing the installed reservoir 115 with a flexible reservoir/hose of a different size and/or diameter, preferably using connectors 116. Preferably, universal or "Chicago" style connectors in 0.75 inches or 1-inch sizes are used for connectors 116.

In the prior air-operated hammer discussed above, the "air reservoir" was fixed (bolted) onto the frame of the hammer, with the main valve sandwiched in between. The cylinder sat on top of the main valve and was incased in the air reservoir. The valve system was comprised of the main valve, master valve, and shuttle valve. The master and shuttle valve were bolted to a manifold, which was bolted to the air reservoir.

Air-operated hammer 100 of the present disclosure features a flexible reservoir (hose) 115 which is preferably connected to the upper housing 101. Preferably, cylinder 110 is disposed inside of ram 130, with the flexible reservoir 115 supplying pressurized air to the cylinder 110 from manifold 120 and valve 121, which are preferably welded to upper housing 101. Main valve 121 is preferably modular, is disposed on manifold 120 and replaces the prior 3-valve system described above.

Air-operated hammer 100 of the present disclosure comprises a main valve 121 with manifold 120 that can be converted to "double acting" (lifting and pushing down) of ram 130 using cylinder 110 and piston 111, resulting in a "boost", or added energy transfer in addition to gravity causing 130 to fall in the downstroke of hammer 100. For this purpose, cylinder head 114 has one or more pressurized air inlets 118 for receiving pressurized air via hoses 124 from manifold 120 and valve 121 preferably disposed on top of upper housing 101.

In the prior air-operated hammer described above, energy transfer dwell (timing) was timed via "limit switch" to "shuttle valve" to "main valve". In air-operated hammer 100 of the present disclosure, dwell is accomplished via the connection of limit switch 141 to main valve 121 where dwell can be adjusted by changing the length of the hose/tubing 142.

In the prior air-operated hammer described above, "limit switches" were mounted on a slide bar that was mounted to the frame of the air-operated hammer. Air-operated hammer 100 of the present disclosure uses limit switches 140 and 141 attached in fixed positions to upper frame 101 to control the reciprocating movement of ram 130.

The components and design of air-operated hammer 100 of the present disclosure allow for greater adaptability in building smaller air-operated hammers as well as larger hammers with lower overall heights.

The air-operated hammer 100 of the present disclosure can utilize a compressed-air source with a lower flow rate and/or lower pressure in comparison with a typical air-operated hammer, in order to achieve the same hammer performance. Alternatively, the air-operated hammer 100 of the present disclosure can utilize an equivalent compressed-air source in comparison with a typical air-operated hammer, in order to achieve superior hammer performance, for example shorter time periods to raise the hammer head, leading to more hammer cycles per time. In addition, other fluid sources can be utilized with air-operated hammer 100 of the present disclosure for example steam and various gases.

The air-operated hammer 100 of the present disclosure also comprises an automatic control valve system 121 which can be utilized to cycle the hammer 101.

Figure 15:
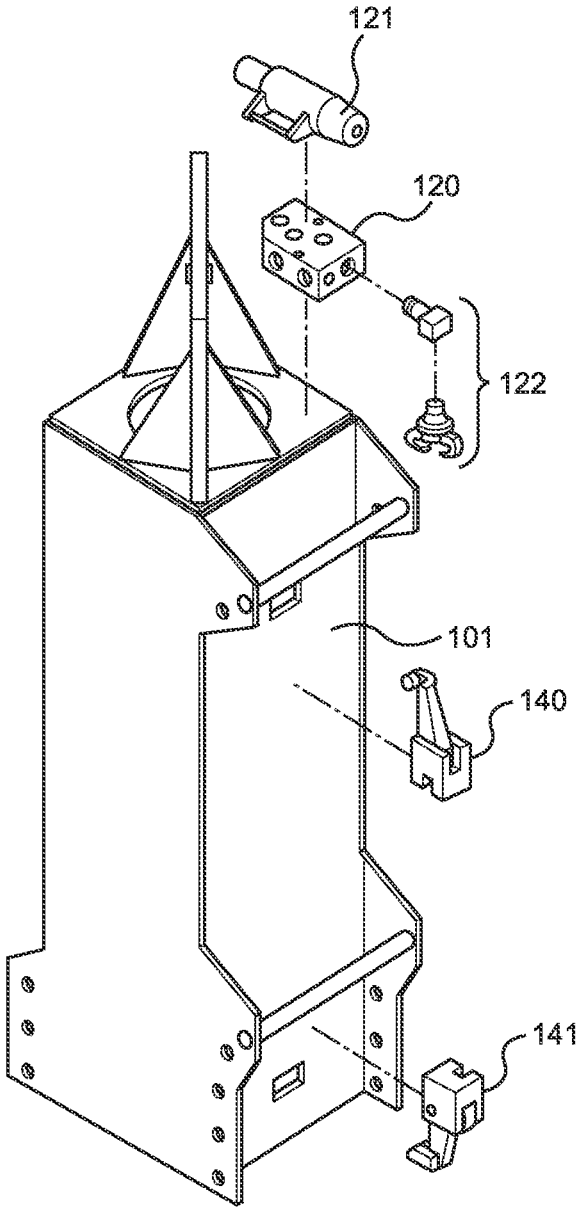
FIG. 15 shows a preferred embodiment of an upper frame component of the air-operated hammer of FIG. 11.
Figure 16:
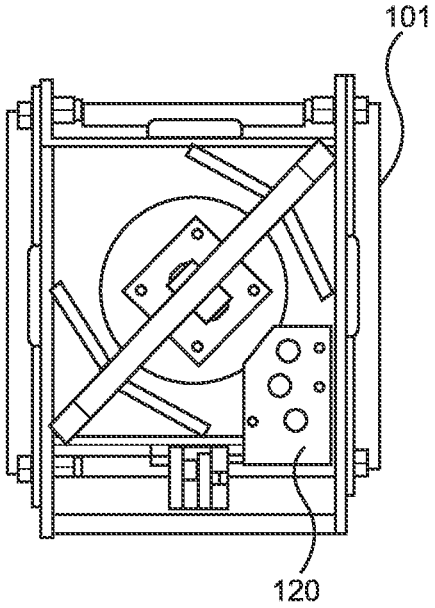
FIG. 16 is a top plan view of a preferred upper frame component of the air-operated hammer of FIG. 11.

As shown in FIGS. 11, 15 and 16, manifold 120 is preferably welded to upper frame 101 and has main valve 121 mounted to it. As shown in FIGS. 23, 23A, 23B, 23C and 24, manifold 120 preferably has external ports as follows: (1) "IN" has the Chicago fitting 122 connected to it and is the inlet for the pressurized Air Source; (2) "B" is ported directly to the IN port and has a constant supply of air available to it; (3) "S" is a small port also connected to the IN port and provides a constant supply of air for the limit switches 140, 141 as needed; (4) *"A" is the main on (pressure)/off (exhaust) port as controlled by the main valve 121; (5) "EX" is the exhaust port that vents pressure from cylinder 110 to atmosphere as controlled by the main valve 121. *ports "A" and "B" change function between single acting and double acting configurations, but "IN", "S", and "EX" remain unchanged.

Figure 17A:
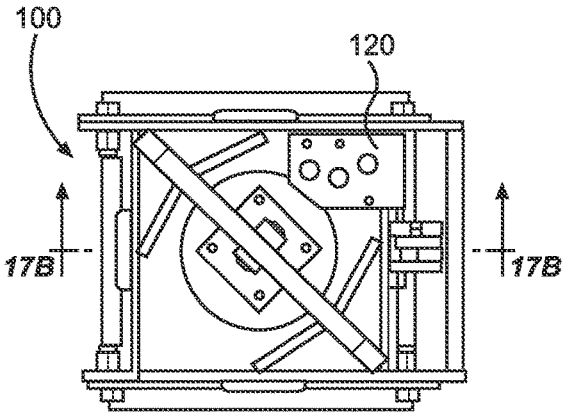
FIG. 17A is a top plan view of the air-operated hammer of FIG. 11 configured for free-fall drops of the ram with the ram at the end of its downstroke.
Figure 17B:
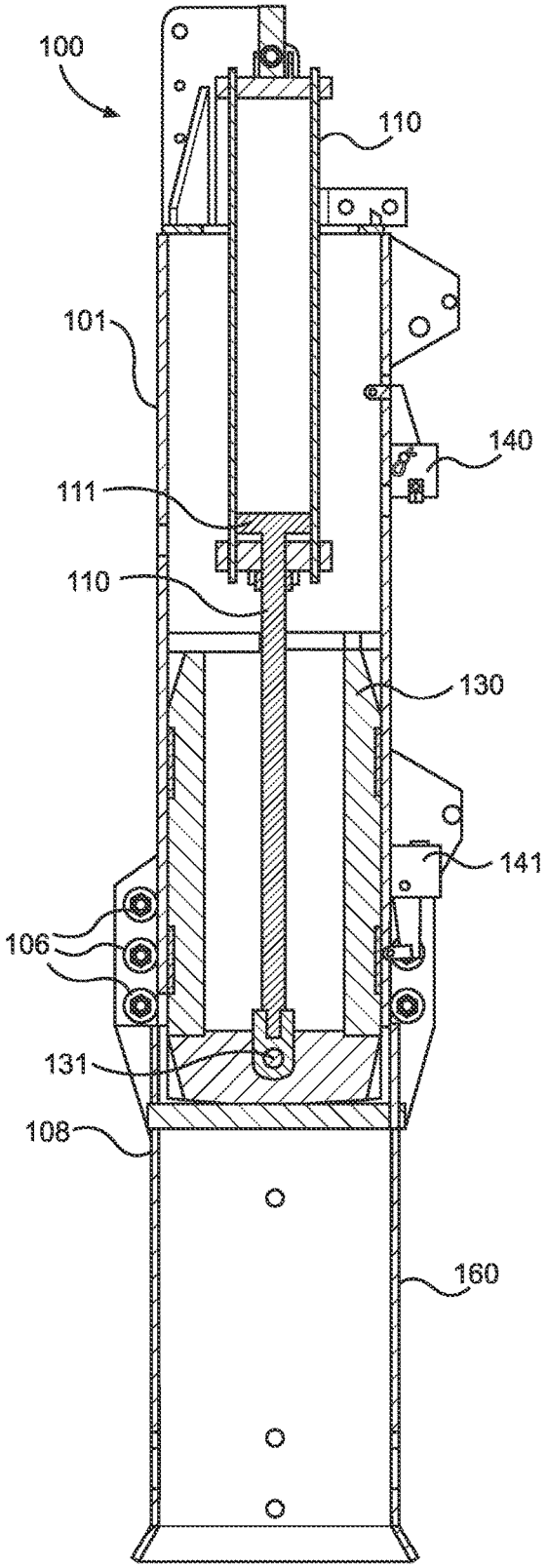
FIG. 17B is a cross-sectional view of the air-operated hammer of FIG. 17A along, Line A-A of FIG. 17A.
Figure 18A:
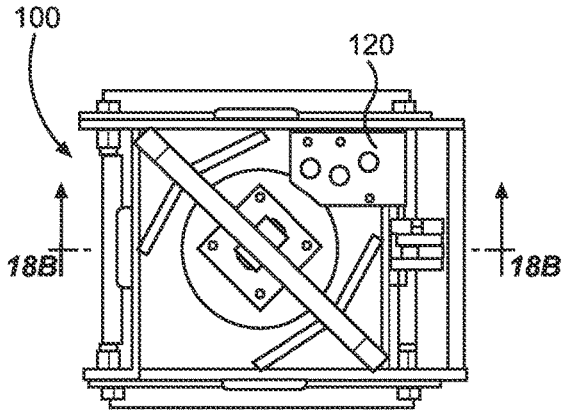
FIG. 18A is a top plan view of the air-operated hammer of FIG. 11 configured for free-fall drops of the ram with the ram near the end of its downstroke.
Figure 18B:
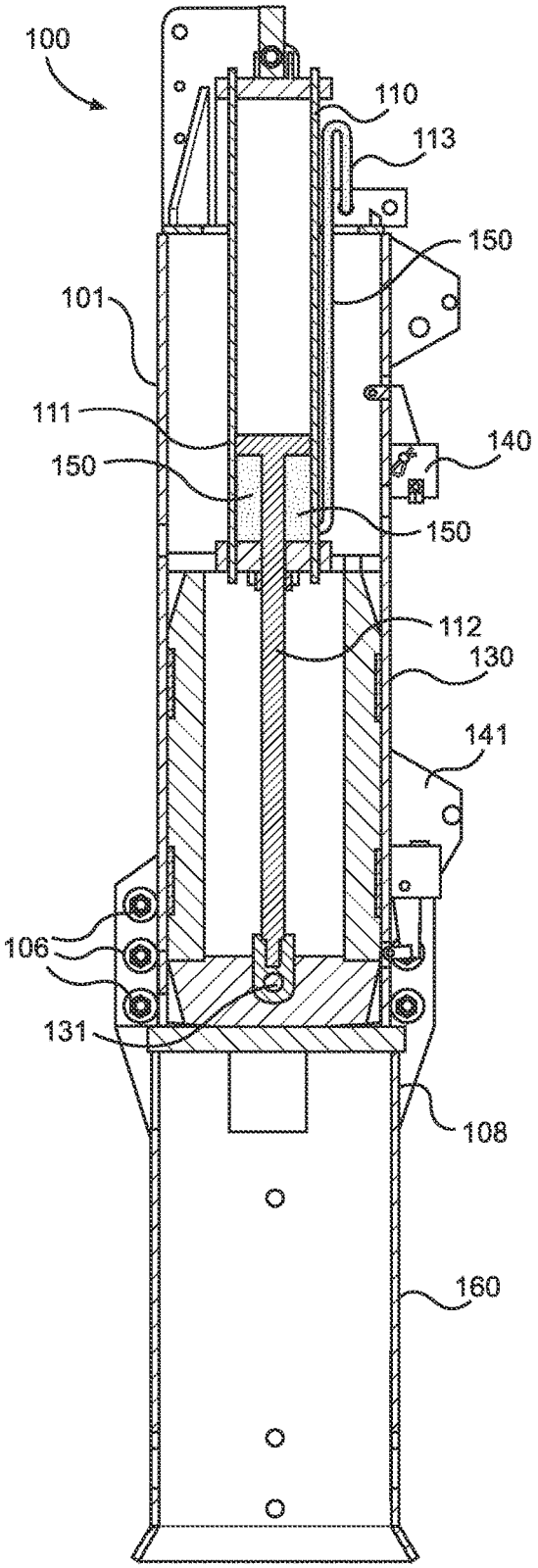
FIG. 18B is a cross-sectional view of the air-operated hammer of FIG. 18A along Line B-B of FIG. 18A.
Figure 19A:
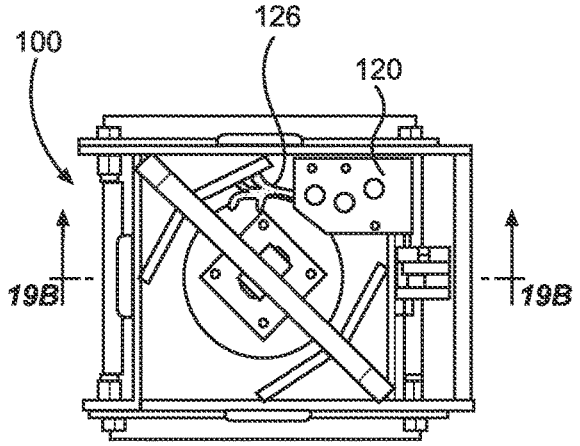
FIG. 19A is a top plan view of the air-operated hammer of FIG. 11 configured for free-fall drops of the ram with the ram at the top of its upstroke.
Figure 19B:
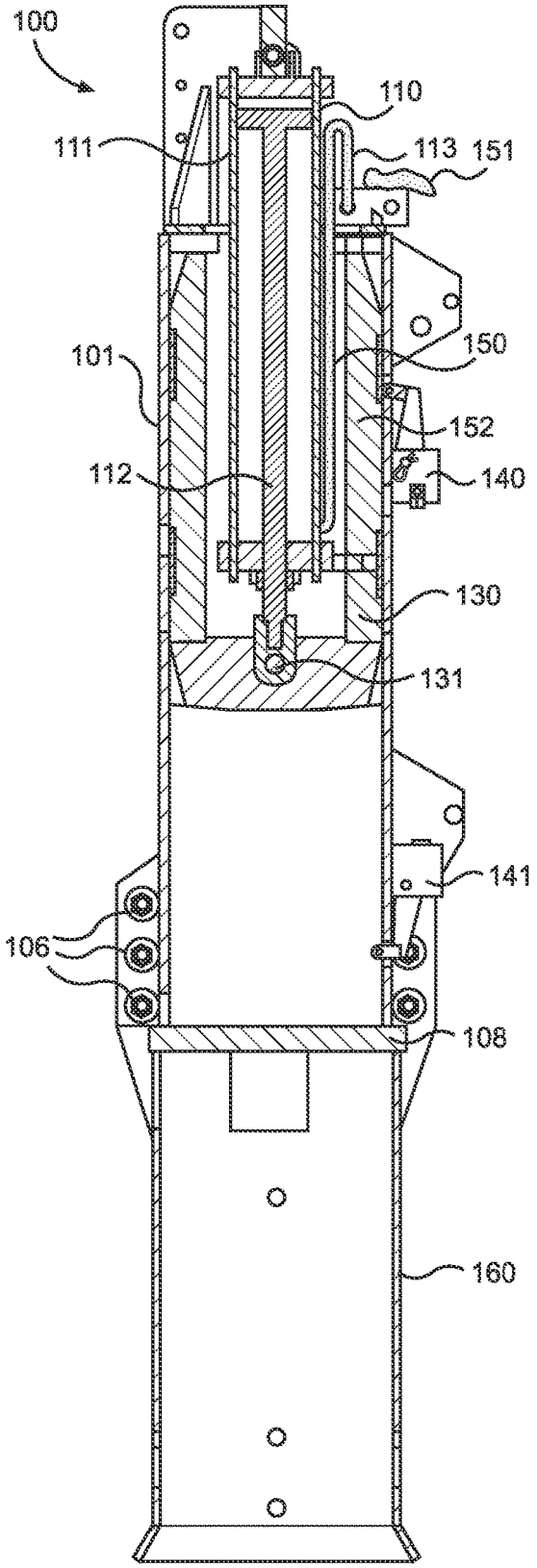
FIG. 19B is a cross-sectional view of the air-operated hammer of FIG. 19A along Line C-C of FIG. 19A.
Figure 20A:
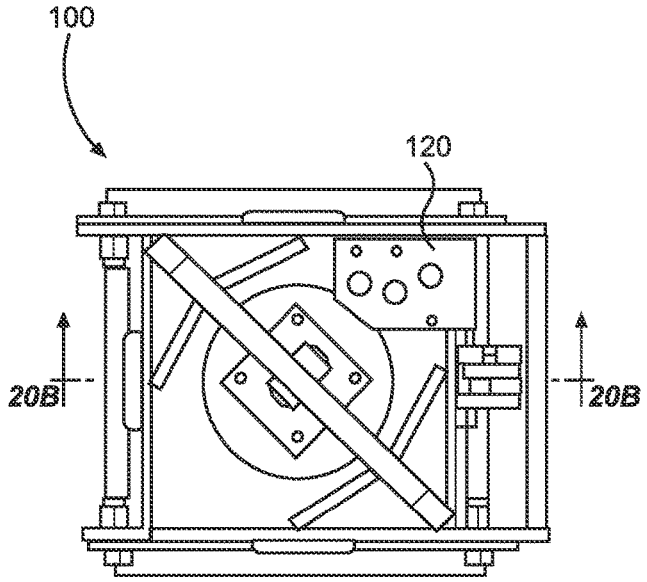
FIG. 20A is a top plan view of the air-operated hammer of FIG. 11 configured for air-powered downstrokes of the ram with the ram at the end of its downstroke.
Figure 20B:
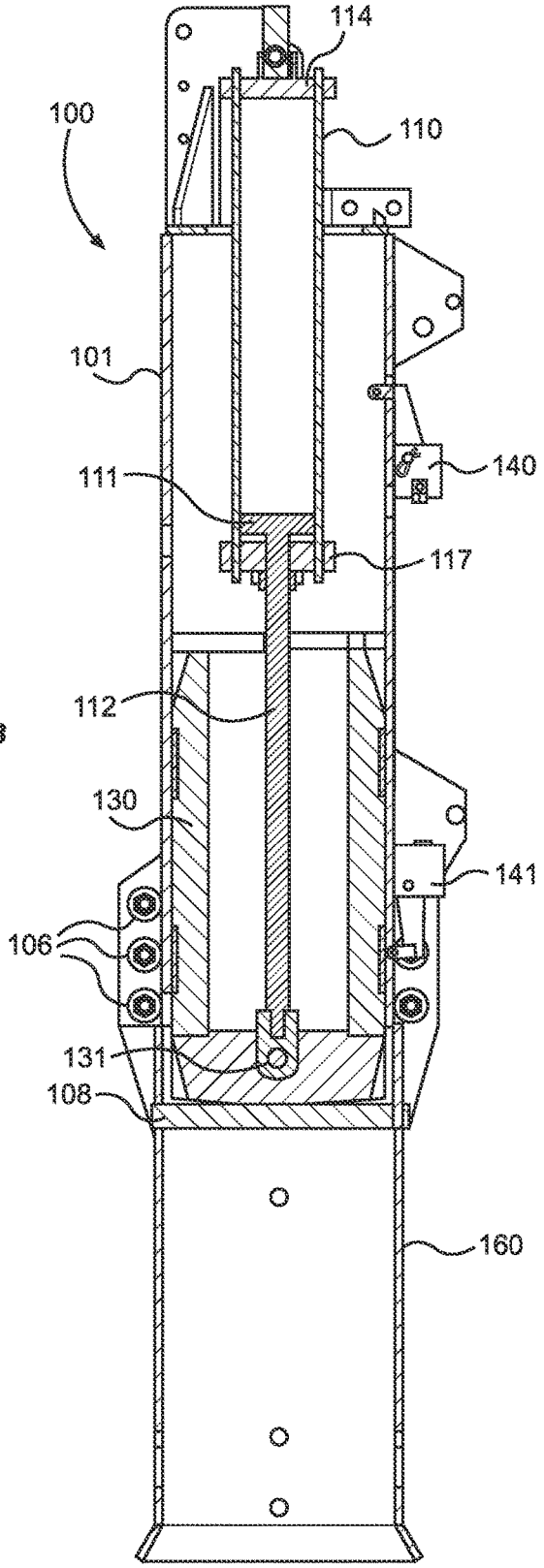
FIG. 20B is a cross-sectional view of the air-operated hammer of FIG. 20A along Line A-A of FIG. 20A.

FIGS. 17A, 1713, 18A, 18B, 19A, 19B, 25 and 26 show air-operated hammer 100 of FIG. 11 configured for free-fall drops of ram 130. Single Acting "Free Fall" mode on the hammer 100 consists of cylinder hose 113 being connected to "A" port of manifold 120 and lower cylinder port 119. "B" port is plugged. At start up, hammer 100 rests on a pile (not shown) with ram 130 at the end of its downstroke and in contact with striker plate 108 as shown in FIG. 17B. Pressurized air from flexible reservoir 115 is directed to the hammer 100 via universal fitting 122 flowing into the "IN" port on manifold 120 and pressurizes the main valve 121 and limit switches 140, 141 (via the "S" port). The lower limit switch 141 is at that point activated by the lower ram ramp 105, and sends a pressurized air signal to the main valve 121 shifting it to direct the main flow of pressurized air out through the "A" port on manifold 120. The pressurized air 150 then flows through cylinder hose 113 and into the lower cylinder port 119. This build-up of pressurized-air 150 under piston 111 forces the ram 130 upward via the rod 112 and pin 131 as shown in FIG. 18B. Since the upper cylinder ports in manifold 120 are open to atmosphere, piston 111, rod 112 and ram 130 accelerate up unhindered.

When the ram 130 nears the top of its stroke, ram ramp 104 triggers limit switch 140 which sends a pressurized air signal to the main valve 121. This pressurized air signal shifts the main valve 121, directing the pressurized air in the cylinder hose 113 to the exhaust port ("EX"), venting all pressurized air from cylinder 110 under piston 111 out to the atmosphere as shown at 151 in FIG. 19B. At this point both the upper 118 and lower 119 cylinder ports are open to atmosphere and the cylinder 110 breaths freely as ram 130 drops, impacting the striker/drive plate 108, transferring the energy into the pile (not shown) while ram ramp 105 activates the lower limit switch 141 to repeat the cycle. The cycle continues to repeat itself as long as pressurized air is supplied to the hammer 110.

FIGS. 13-15, 20A, 20B, 21A, 21B, 22A, 22B, 27 and 28 show air-operated hammer 100 of FIG. 11 configured for pressurized air-powered downstrokes of the ram 130. Here, double-acting "powered fall" mode consists of the cylinder hose 113 being connected to "B" port on manifold 120 and to lower cylinder port 119. Hose assembly 124 is connected to "A" port on manifold 120 and to the two upper cylinder ports 118 on cylinder head 114.

Figure 21A:
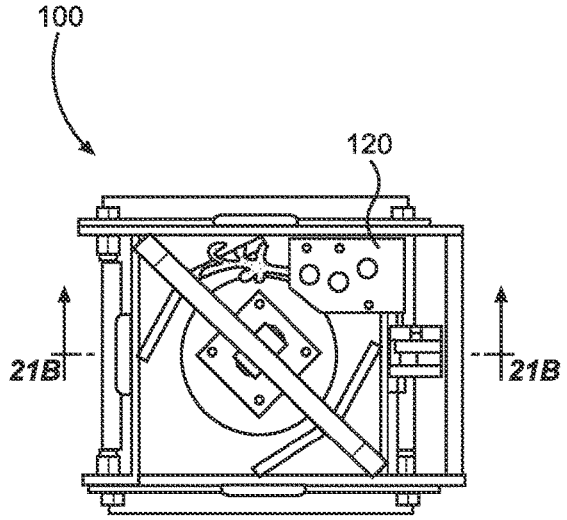
FIG. 21A is a top plan view of the air-operated hammer of FIG. 11 configured for air-powered downstrokes of the ram with the ram near the end of its downstroke.
Figure 21B:
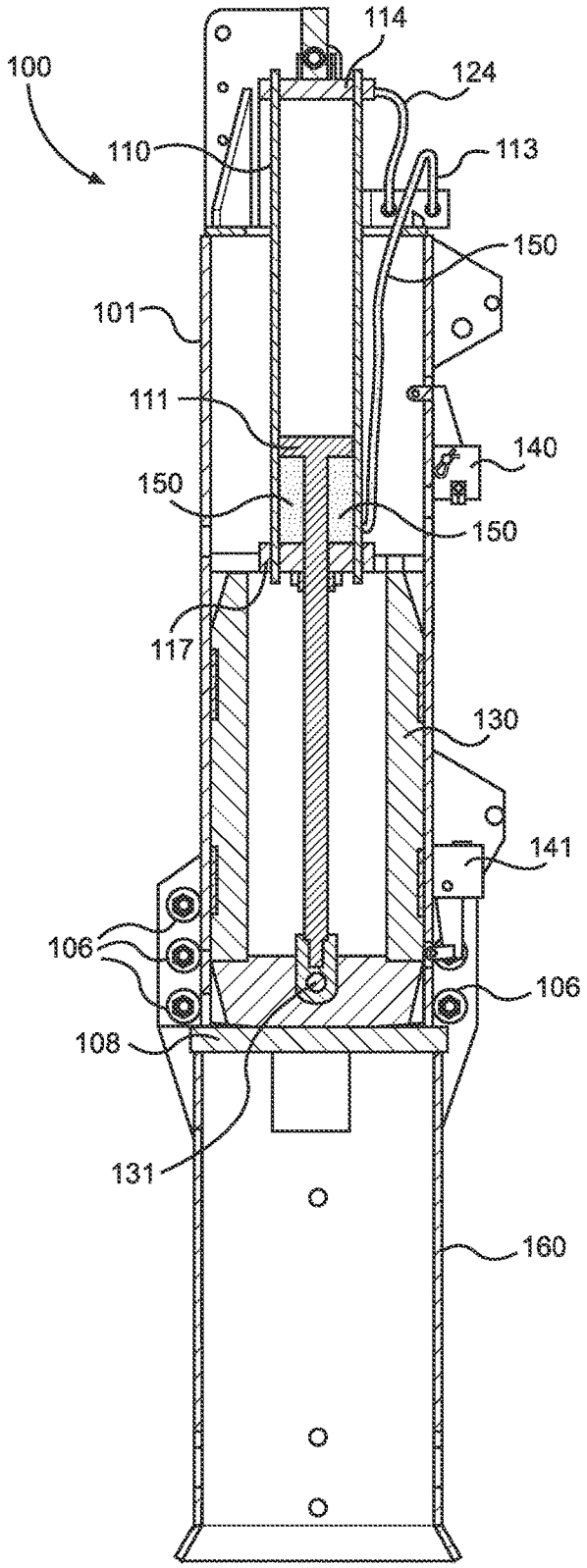
FIG. 21B is a cross-sectional view of the air-operated hammer of FIG. 21A along Line B-B of FIG. 21A.

At start up, with hammer 100 resting on a pile, pressurized air from flexible reservoir 115 is directed to hammer 100 via universal fitting 122. The pressurized air flows into the "IN" port of manifold 120 and pressurizes "S" port, "B" port and the main valve 121. Lower limit switch 141 is at that time activated by ramp 105 on ram 130, and sends a pressurized-air signal to main valve 121 to shift it to its Exhaust position, venting all air from the cylinder 110 above piston 111 via hose assembly 124. With pressurized air 150 present in cylinder 110 below piston 111 via hose 113 connected to port "B" on manifold 120, the force acting on piston 111 accelerates the piston 111, rod 112, pin 131 and ram 130 upward as shown in FIG. 21B. Since the cylinder 110 above piston 111 is vented to atmosphere at 125 in FIG. 21A via ports 118 and hose assembly 124 through main valve 121, ram 130 accelerates upward unhindered.

Figure 22A:
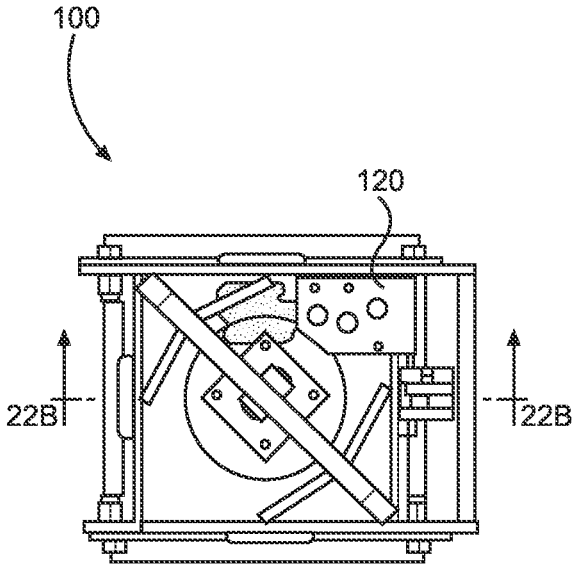
FIG. 22A is a top plan view of the air-operated hammer of FIG. 11 configured for air-powered downstrokes of the ram with the ram at the top of its upstroke.
Figure 22B:
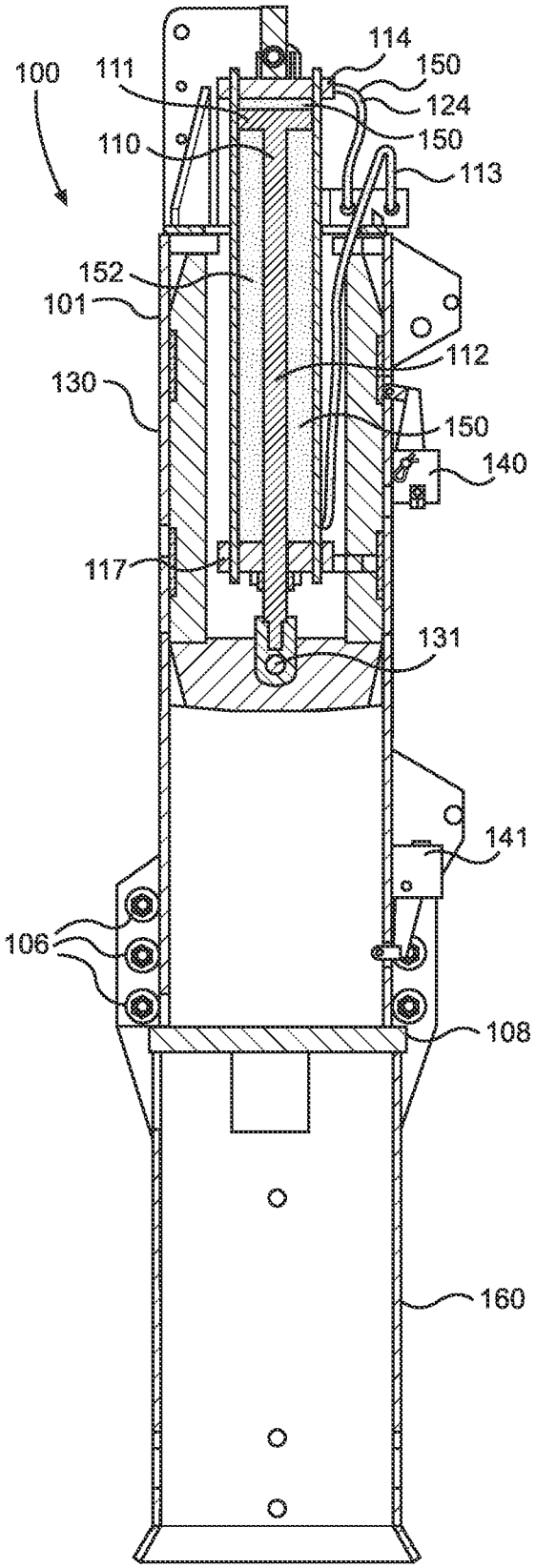
FIG. 22B is a cross-sectional view of the air-operated hammer of FIG. 22A along Line C-C of FIG. 22A.
Figure 23B:
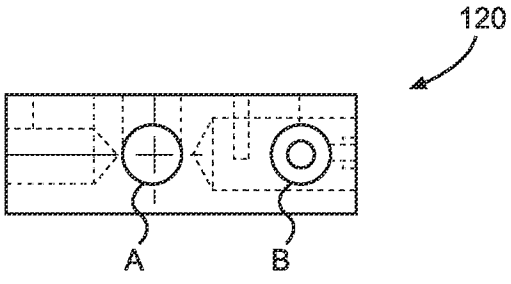
FIG. 23B is a front elevational view of the manifold of FIG. 23.
Figure 23A:
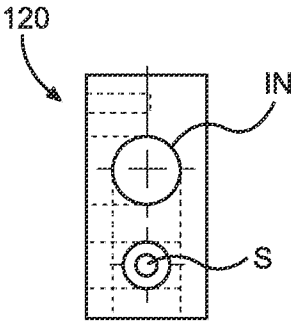
FIG. 23A is a right-side view of the manifold of FIG. 23.
Figure 23:
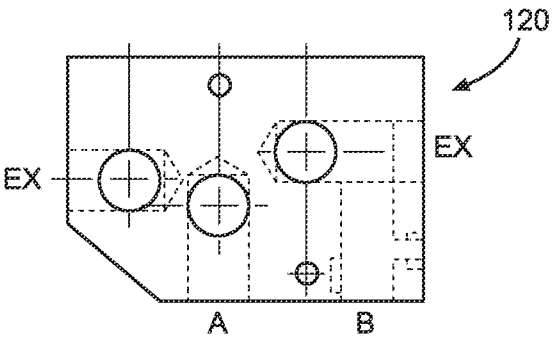
FIG. 23 is a top plan view of a preferred manifold of the air-operated hammer of FIG. 11.
Figure 24:
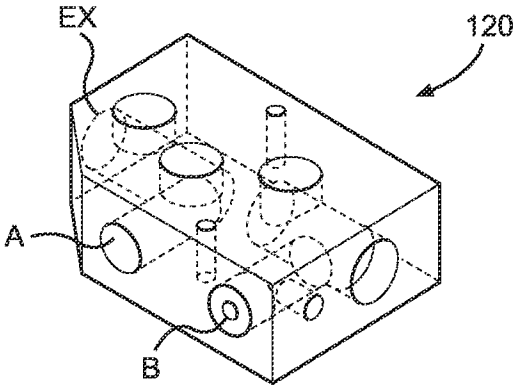
FIG. 24 is a top perspective view of the manifold of FIG. 23.
Figure 23C:
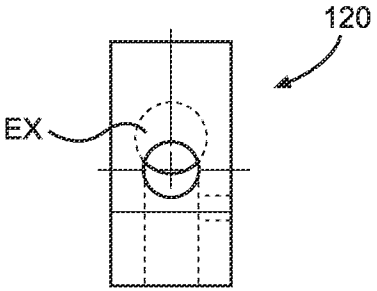
FIG. 23C is a left side view of the manifold of FIG. 23.
Figure 27:
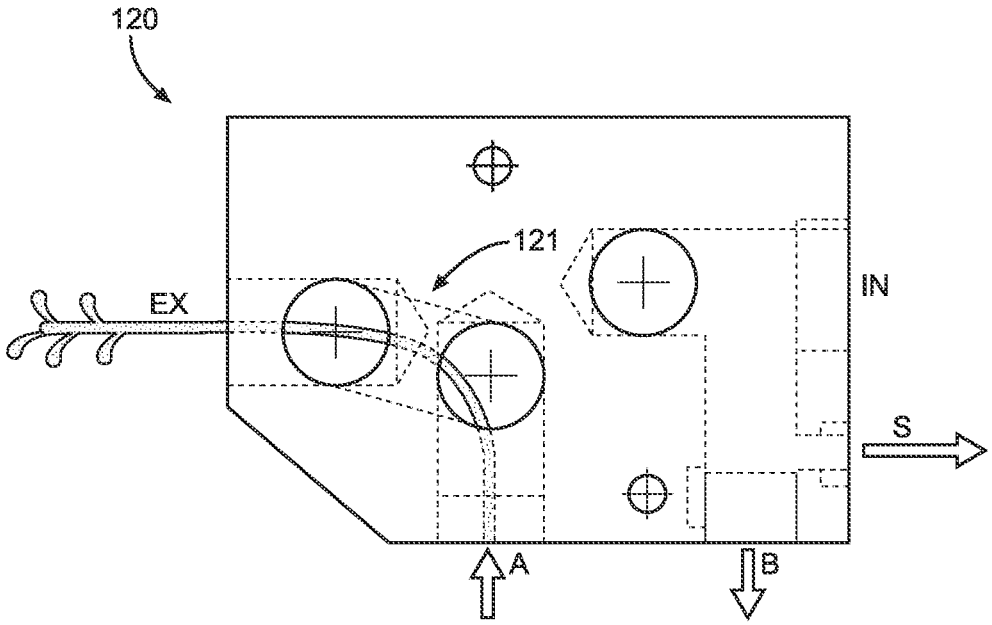
FIG. 27 is a top plan view of the manifold of FIG. 23 showing pressurized air and exhaust flows in said manifold during ram raise in the air-operated hammer of FIG. 11 configured for air-powered downstrokes of the ram.
Figure 28:
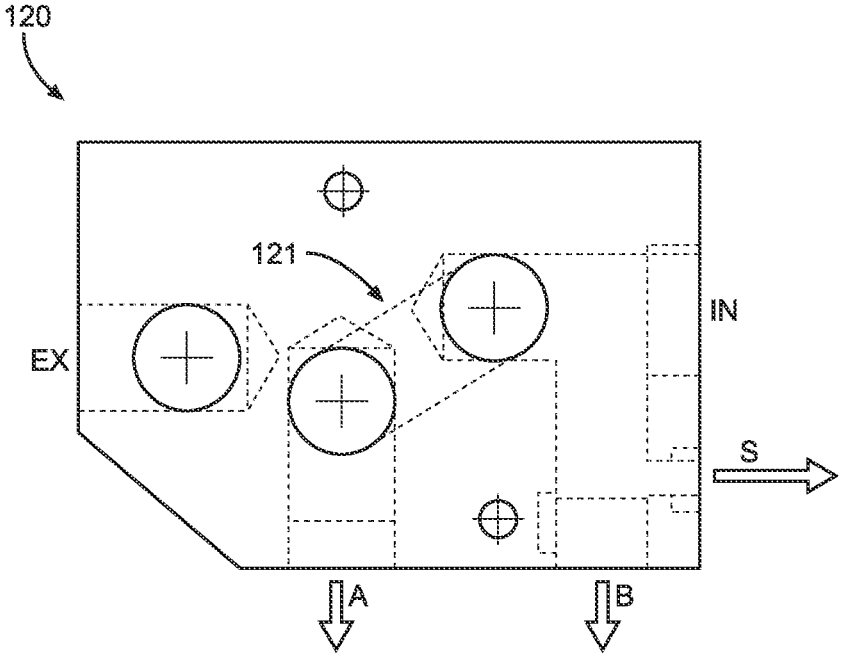
FIG. 28 is a top plan view of the manifold of FIG. 23 showing pressurized air flows in said manifold during ram drop in the air-operated hammer of FIG. 11 configured for air-powered downstrokes of the ram.
Figure 25:
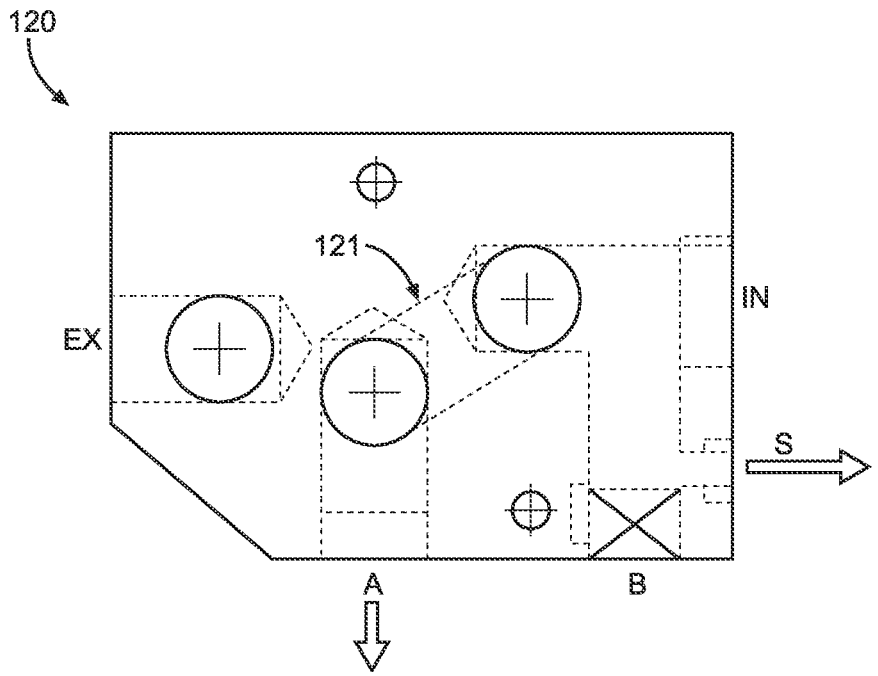
FIG. 25 is a top plan view of the manifold of FIG. 23 showing pressurized air flow in said manifold during ram raise in the air-operated hammer of FIG. 11 configured for free-fall drops of the ram.
Figure 26:
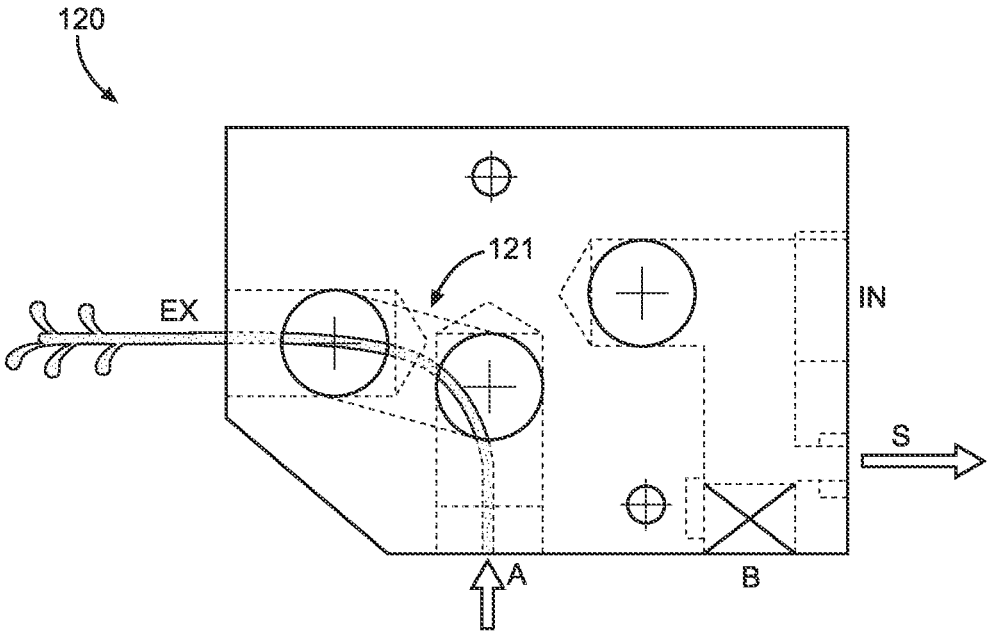
FIG. 26 is a top plan view of the manifold of FIG. 23 showing pressurized air and exhaust flows in said manifold during ram drop in the air-operated hammer of FIG. 11 configured for free-fall drops of the ram.

When ram 130 nears the top of its upstroke, ramp 104 triggers upper limit switch 140 causing it to send a pressurized-air signal to the main valve 121 shifting it to direct pressurized air out of the "A" port on manifold 120 while simultaneously closing off exhaust port EX, through hose assembly 124, to supply pressurized air 150 to cylinder 110 above piston 111 via ports 118. At this point both upper and lower cylinder ports 118 and 119, respectively, have pressurized air present and thus pressurized air is present above and below piston 111 as shown in FIG. 22B. The underside of piston 111 has less surface area on it than the upper side of piston 111 because of the cylinder rod 112, causing a force imbalance that arrests the upward motion of ram 130 and also causes piston 111 to start accelerating downward. The acceleration of the ram 130 downward is boosted (powered) by the force imbalance causing it to accelerate faster than it would in "free fall" mode. Since port "A" and port "B" are now connected via the hoses 113 and 124 through the main valve 121, the pressurized air in cylinder 110 under piston 111 is allowed to flow around to the upper side of cylinder 110 above piston 111 allowing rapid downward travel of ram 130.

When ram 130 reaches the bottom of its downstroke, it impacts the striker/drive plate 108, transferring the kinetic energy into the pile to drive it into the ground. At the same time ramp 105 triggers the lower limit switch 141 which sends a pressurized-air signal to the main valve 121 via dwell-time adjustment tube 142. Such signal shifts main valve 121 to the exhaust position, blocking pressurized air from entering port "A" on manifold 120 while simultaneously connecting port "A" to exhaust port "EX" on manifold 120. Pressurized air is vented from the cylinder 110 above piston 111 which causes (i) ram 130 to rise on its upstroke and (ii) pressurized air to remain present in cylinder 110 below piston 111 throughout the upstroke/downstroke cycle of ram 130. At this point ram 130 is accelerated upwards and the upstroke/downstroke cycle of ram 130 continues to repeat itself as long as pressurized air is supplied to the hammer 100. Adjusting the length of dwell-time adjustment tube 142 by replacing it on hammer 100 with a longer or shorter tube lengthens or shortens, respectively, the dwell-time during which ram 130 remains at the bottom of its downstroke in contact with striker plate 108 during each downstroke of ram 130.

All patents, patent applications, provisional applications, and publications referred to or cited herein are incorporated by reference in their entirety for all purposes.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. An air-operated hammer, comprising:

a hollow ram;

a frame;

an air cylinder and piston assembly comprising an air cylinder and a piston disposed within the ram, wherein a top of the air cylinder and piston assembly is attached to a top of the frame and wherein a piston rod of the air cylinder and piston assembly is attached to a bottom of the ram;

an air flow control valve mounted on and in fluid communication with a manifold disposed on a top of the frame;

a pressurized air reservoir comprising a first flexible hose attached to an outside surface of the frame, wherein lifting of the ram is caused by pressurized air from the pressurized air reservoir being supplied to and entering a bottom of the air cylinder to lift the piston and the ram.

2. The air-operated hammer of claim 1, wherein the first flexible hose may comprise a flexible hose of various sizes as required for operation of the air-operated hammer.

3. The air-operated hammer of claim 1, further comprising an upper limit switch attached to an upper portion of the frame and lower limit switch attached to the frame below the upper limit switch.

4. The air-operated hammer of claim 1, further comprising a dwell-adjustment air tube connected in fluid communication between the lower limit switch and the air flow control valve for regulating dwell time of the ram at a bottom travel limit of the ram.

5. The air-operated hammer of claim 4, wherein the dwell-adjustment air tube is adjustable for adjusting the dwell time of the ram at the bottom travel limit of the ram.

6. The air-operated hammer of claim 1, further comprising one or more downstroke assist air tubes connected in fluid communication between the air flow control valve and respective one or more air inlets in a cylinder head of the air cylinder for supplying pressurized air into the air cylinder above the piston to assist in forcing the ram downward during a downstroke of the ram while pressurized air below the piston is allowed to flow through the air flow control valve and into the air cylinder above the piston.

* * * * *